US012789955B2

(12) United States Patent
Neibert et al.

(10) Patent No.: US 12,789,955 B2
(45) Date of Patent: Nov. 10, 2026

(54) PONTOON BOAT WITH FLOW-CONTROLLING CHASSIS

(71) Applicant: BARLETTA BOAT COMPANY, LLC, Bristol, IN (US)

(72) Inventors: Mark Neibert, Bronson, MI (US); Timothy DeRyder, Dowagiac, MI (US)

(73) Assignee: Barletta Boat Company, LLC, Bristol, IN (US)

( * ) Notice: Subject to any disclaimer, the term of this patent is extended or adjusted under 35 U.S.C. 154(b) by 187 days.

(21) Appl. No.: 18/920,203

(22) Filed: Oct. 18, 2024

(65) Prior Publication Data

US 2025/0128794 A1 Apr. 24, 2025

Related U.S. Application Data

(60) Provisional application No. 63/545,081, filed on Oct. 20, 2023.

(51) Int. Cl.
*B63B 35/38* (2006.01)
*B63B 1/12* (2006.01)
*B63H 20/02* (2006.01)

(52) U.S. Cl.
CPC ..... *B63B 35/38* (2013.01); *B63B 1/125* (2013.01); *B63H 20/02* (2013.01)

(58) Field of Classification Search
CPC ..... B63B 35/38; B63B 1/125; B63B 1/20; B63B 1/22; B63B 32/64; B63H 20/02
USPC ..... 114/271, 274, 278, 283, 288, 292, 61.1
See application file for complete search history.

(56) References Cited

U.S. PATENT DOCUMENTS

| | | | | | |
|---|---|---|---|---|---|
| 2,950,699 | A * | 8/1960 | Ogden | B63B 34/00 | 440/70 |
| 3,289,226 | A * | 12/1966 | Thompson | B63B 1/12 | 114/361 |
| 5,259,331 | A * | 11/1993 | Hagan | B63H 5/16 | 114/61.1 |
| 6,016,762 | A * | 1/2000 | Price | B63B 1/18 | 114/274 |
| 6,477,969 | B2 | 11/2002 | Schell-Tomczak et al. | | |
| 6,482,056 | B1 * | 11/2002 | Schell-Tomczak | B63H 20/06 | 248/641 |
| 6,939,184 | B2 | 9/2005 | Fishburn et al. | | |
| 7,950,340 | B1 * | 5/2011 | Curtis | B63B 1/125 | 114/61.1 |
| 9,156,526 | B2 * | 10/2015 | Handley | B63B 35/34 | |
| 9,233,732 | B2 * | 1/2016 | Wilson | B63B 35/34 | |
| 9,415,836 | B1 | 8/2016 | Eekhoff et al. | | |
| 9,873,487 | B1 * | 1/2018 | Eekhoff | B63B 1/125 | |
| 10,953,955 | B1 * | 3/2021 | Fieldhouse | B63B 1/32 | |
| 11,192,610 | B2 * | 12/2021 | Fishburn | B63B 1/125 | |

(Continued)

*Primary Examiner* — Tye William Abell
(74) *Attorney, Agent, or Firm* — Barnes & Thornburg LLP

(57) ABSTRACT

A pontoon boat includes a frame, a port pontoon and a starboard pontoon underneath and attached to the frame, and a motor pod attached to an aft end of the frame. An outboard motor may be attached to a transom of the motor pod. An inclined running surface extends forward and upward from forward and lower ends of the motor pod. The motor pod and the inclined running surface cooperate to channel water flowing underneath the pontoon boat and between the port and starboard pontoons underneath the motor pod, toward a propulsor of the outboard motor and away from midsections of the outboard motor.

22 Claims, 49 Drawing Sheets

(56) References Cited

U.S. PATENT DOCUMENTS

| | | | | |
|---|---|---|---|---|
| 11,312,450 | B1 * | 4/2022 | Rose | B63H 21/30 |
| 2002/0046688 | A1 * | 4/2002 | Schell-Tomczak | B63B 1/12 114/61.1 |
| 2004/0175996 | A1 | 9/2004 | Fishburn et al. | |
| 2005/0250393 | A1 | 11/2005 | Fishburn et al. | |
| 2009/0130926 | A1 | 5/2009 | Jaszewski et al. | |
| 2011/0132251 | A1 * | 6/2011 | Wilson | B63B 1/12 114/292 |
| 2011/0179985 | A1 * | 7/2011 | Anderson | B63B 35/34 114/61.1 |
| 2018/0304968 | A1 * | 10/2018 | Minor | B63B 1/242 |
| 2020/0094919 | A1 * | 3/2020 | Fenech | B63B 1/121 |
| 2020/0164948 | A1 * | 5/2020 | Neibert | B63B 1/125 |
| 2024/0059373 | A1 * | 2/2024 | Dinninger | B63B 1/30 |

* cited by examiner

PONTOON BOAT WITH FLOW-CONTROLLING CHASSIS

CROSS-REFERENCE TO RELATED APPLICATIONS

This application claims benefit under 35 U.S.C. § 119 of U.S. Provisional Patent Application No. 63/545,081, filed Oct. 20, 2023, and incorporates by reference the disclosure thereof in its entirety.

BACKGROUND OF THE INVENTION

Pontoon boats are known in the art. Pontoon boats typically include a first (or port) pontoon and a second (or starboard) pontoon spaced from and parallel to the first pontoon, a frame connected to the first and second pontoons, and a deck supported by the frame. The first and second pontoons cooperate to define a water channel therebetween through which water passes as the pontoon boat travels in a forward direction.

Some pontoon boats further include a third (or center) pontoon connected to the frame, the third pontoon being located between, spaced from, and parallel to the first and second pontoons. In such embodiments, the first and third pontoons cooperate to define a first water channel through which water passes as the pontoon boat travels in a forward direction, and the second and third pontoon cooperate to define a second water channel through which water passes as the pontoon boat travels in the forward direction.

Pontoon boats typically include one or more outboard motors. Such outboard motors typically include a powerhead, a lower unit, and a midsection. The powerhead includes the engine. The power head typically remains above the water line when the pontoon boat is in use. The lower unit includes a gearbox and propeller or other propulsor (for example, a jet drive). The lower unit typically remains below the water line when the pontoon boat is in use. The midsection connects the powerhead and the lower unit. The midsection may include a drive shaft connecting the engine with the lower unit gearbox, engine exhaust piping, and engine cooling water piping, among other components. The midsection may include one or more outer covers that may be referred to as "chaps." The outer covers shield components internal to the midsection from flowing water when the pontoon boat is in operation. Although the midsection typically is located at least in part above the water line when the pontoon boat is in use, it is subject to hydraulic forces and drag resulting from interaction with the relative flow of water underneath and/or alongside the pontoon boat when the pontoon boat is in normal use, as discussed further below.

As suggested above, some pontoon boats include a single outboard motor attached to a transom located midway between the first and second pontoons. In such embodiments, the transom may be a component of a motor pod that is connected to one or more of the frame, the first pontoon, the second pontoon, and the third pontoon (in three-pontoon embodiments). The single outboard motor is pivotable between first and second (or port and starboard) pivot limits to turn the pontoon boat to port or starboard. Single-motor pontoon boats with conventional motor pods and transoms typically expose the midsection of the outboard motor to interaction with the relative flow of water underneath the pontoon boat and around the outboard motor when the pontoon boat is in normal use, as discussed further below.

Other pontoon boats include first and second outboard motors, with the first motor connected to a first transom located behind the first pontoon, and the second motor connected to a second transom located behind the second pontoon. The first transom may be a component of a first motor pod connected to the first pontoon and/or to the frame proximate the first pontoon. Similarly, the second transom may be a component of a second motor pod connected to the second pontoon and/or to the frame proximate the second pontoon. As such, the motors and propellers of known pontoon boats having two outboard motors typically are spaced about the width of the boat apart from each other, with rotational centerlines of the propellers below and substantially in vertical alignment with longitudinal centerlines of the respective pontoons. Each of the first and second outboard motors is pivotable between first and second (or port and starboard) pivot limits to turn the boat to port or starboard. Dual motor pontoon boats with conventional transoms typically expose the midsections of each of the outboard motors to interaction with the relative flow of water underneath and alongside the pontoon boat and around the midsections of each of the outboard motors when the pontoon boat is in normal use, as discussed further below.

The foregoing exposure of the midsection(s) of the outboard motor(s) to interaction with the flow of water underneath and/or alongside the pontoon boat creates drag forces on the midsection(s) of the outboard motor(s). These drag forces may adversely affect the operating efficiency of the pontoon boat. Also, when the motors are pivoted to turn the pontoon boat, the foregoing interaction with the flow of water underneath and/or alongside the pontoon boat may impart substantial hydraulic forces on the midsection(s) of the outboard motor(s), which forces may tend to push the outboard motor(s) from (a) pivoted position to (a) centered position. As such, these forces may adversely affect the effort required of a user to steer the boat.

Another drawback to conventional dual motor designs is that they preclude locating a swim ladder or platform aft of the deck and outboard of the motors and propulsors, and instead require that such features be located between the motors and propulsors. Such ladder or platform placement requires persons using these features to wade or swim between the motors and their propulsors, with the consequent risk of injury.

SUMMARY OF THE DISCLOSURE

The present disclosure is directed to a pontoon boat having a frame, port and starboard pontoons underneath and attached to the frame, and a motor pod attached to an aft end of the frame. The motor pod carries one or more outboard motors. The motor pod is configured to channel water flowing underneath the pontoon boat and between the port and starboard pontoons to a depth (relative to the frame) proximate propulsors of the motors and away from the midsection of one or more outboard motors attached to a transom of the motor pod. The pontoon boat may include an inclined running surface located between the port and starboard pontoons and forward of the motor pod and transom. The inclined running surface is inclined upwardly from proximate a forward end of the motor pod to a location forward of the motor pod. The inclined running surface may be embodied as a lower surface of a flotation pod underneath and attached to the frame.

DETAILED DESCRIPTION OF THE DRAWINGS

Figure 1:
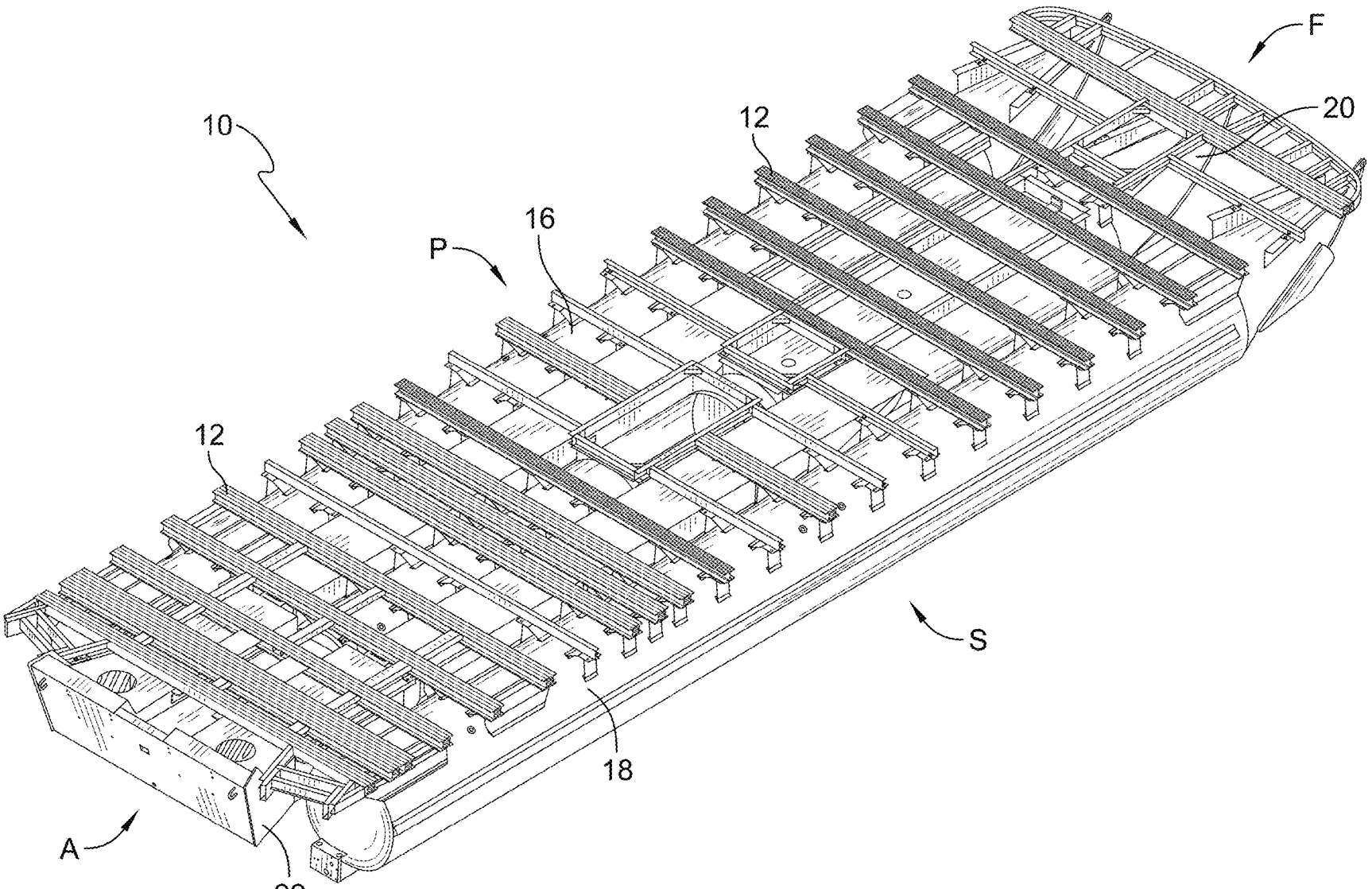
FIG. 1 is an upper rear perspective view of a pontoon boat having a frame, a first (or port) pontoon attached to the frame proximate a first (or port) side thereof, a second (or starboard) pontoon attached to the frame proximate a second (or starboard) side thereof, a third (or center) pontoon attached to the frame between the first and second pontoons, a first set of flotation pods collectively defining a first inclined running surface attached to the frame between the first and third pontoons, a second set of flotation pods collectively defining a second inclined running surface attached to the frame between the second and third pontoons, and a motor pod attached to the frame between aft ends of the first and second pontoons and aft of the third pontoon and the first and second sets of flotation pods, according to the present disclosure.
Figure 2:
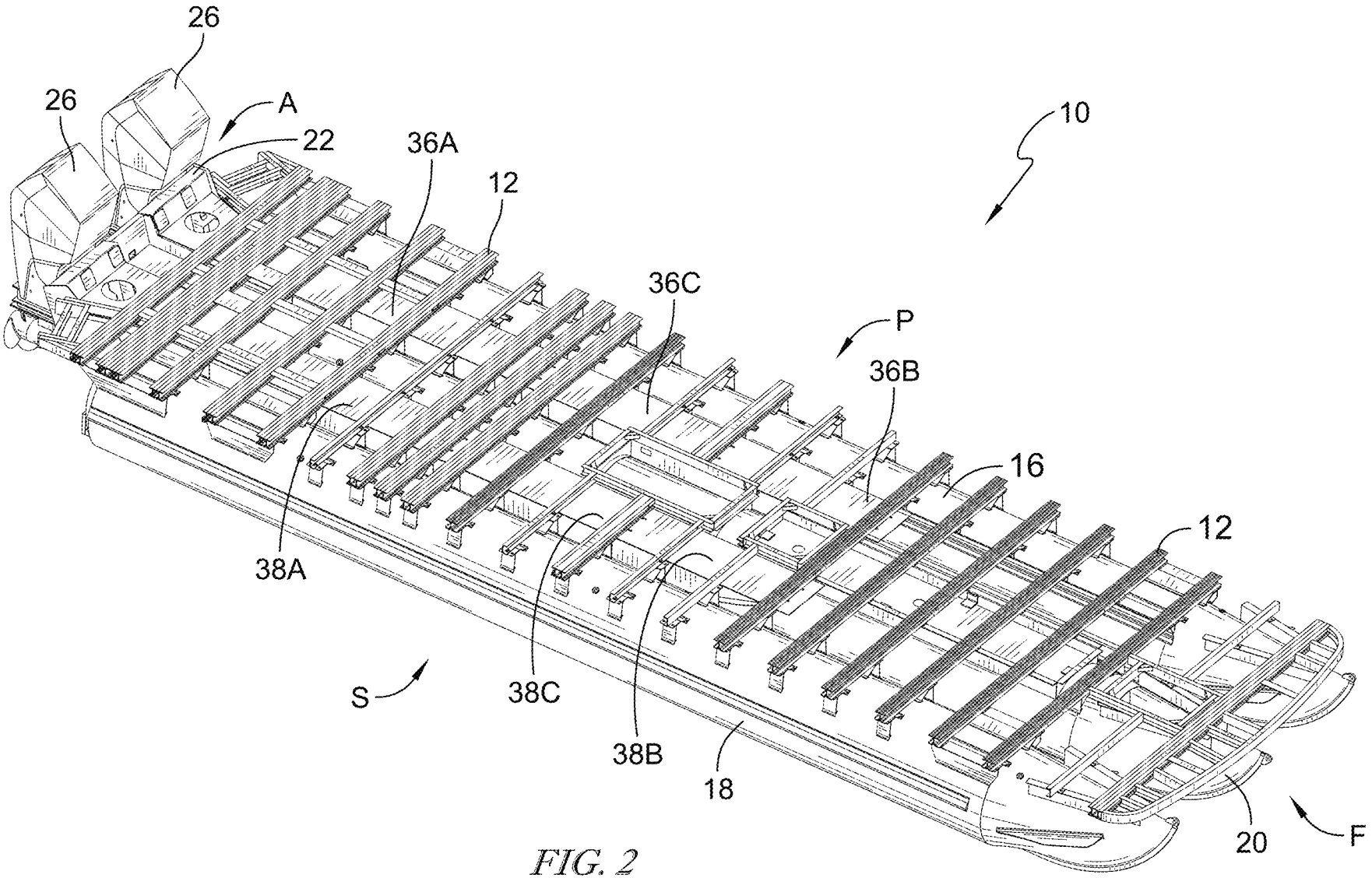
FIG. 2 is an upper front perspective view of the pontoon boat of FIG. 1.
Figure 3:
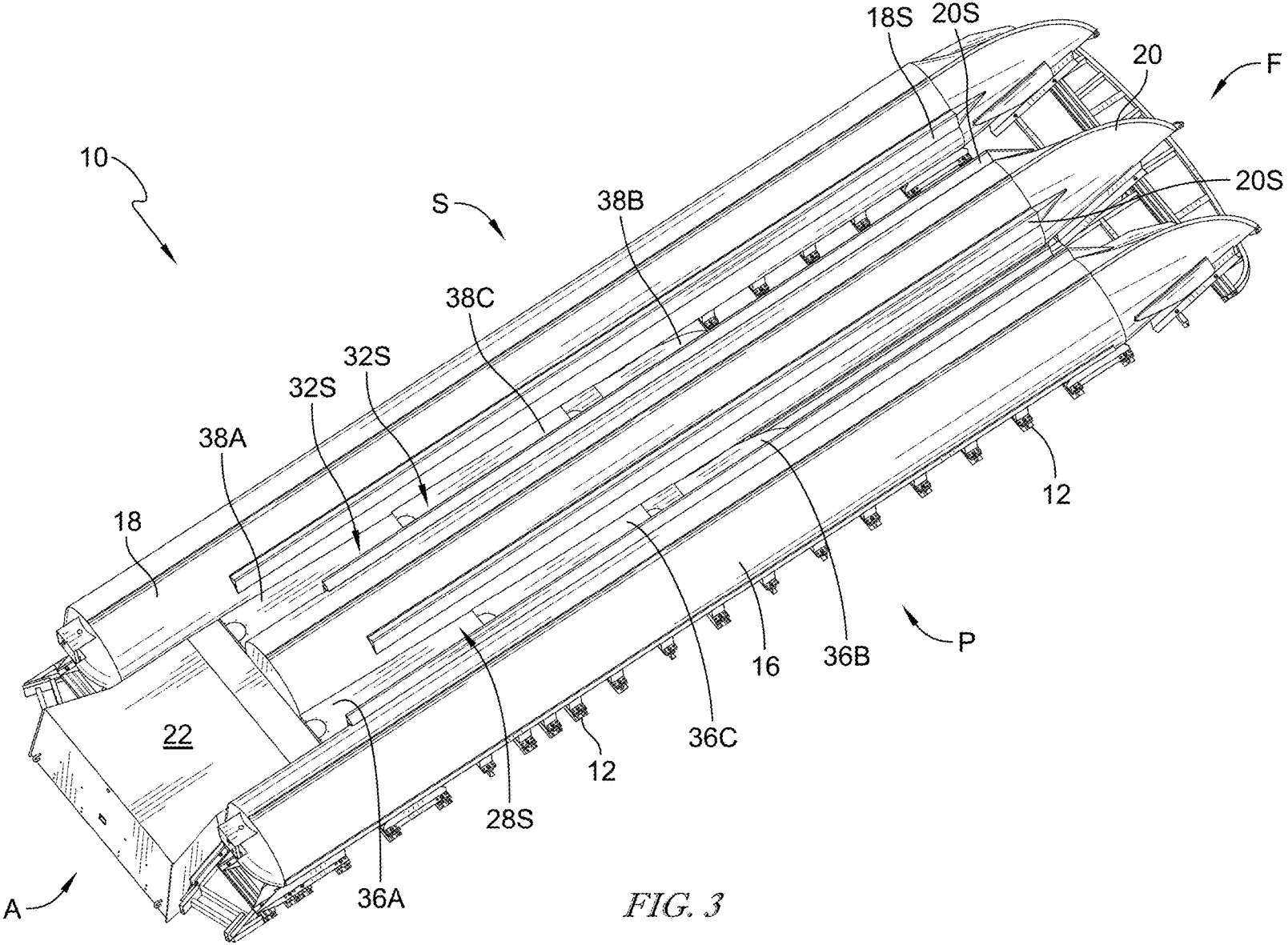
FIG. 3 is a lower aft perspective view of the pontoon boat of FIG. 1.
Figure 4:
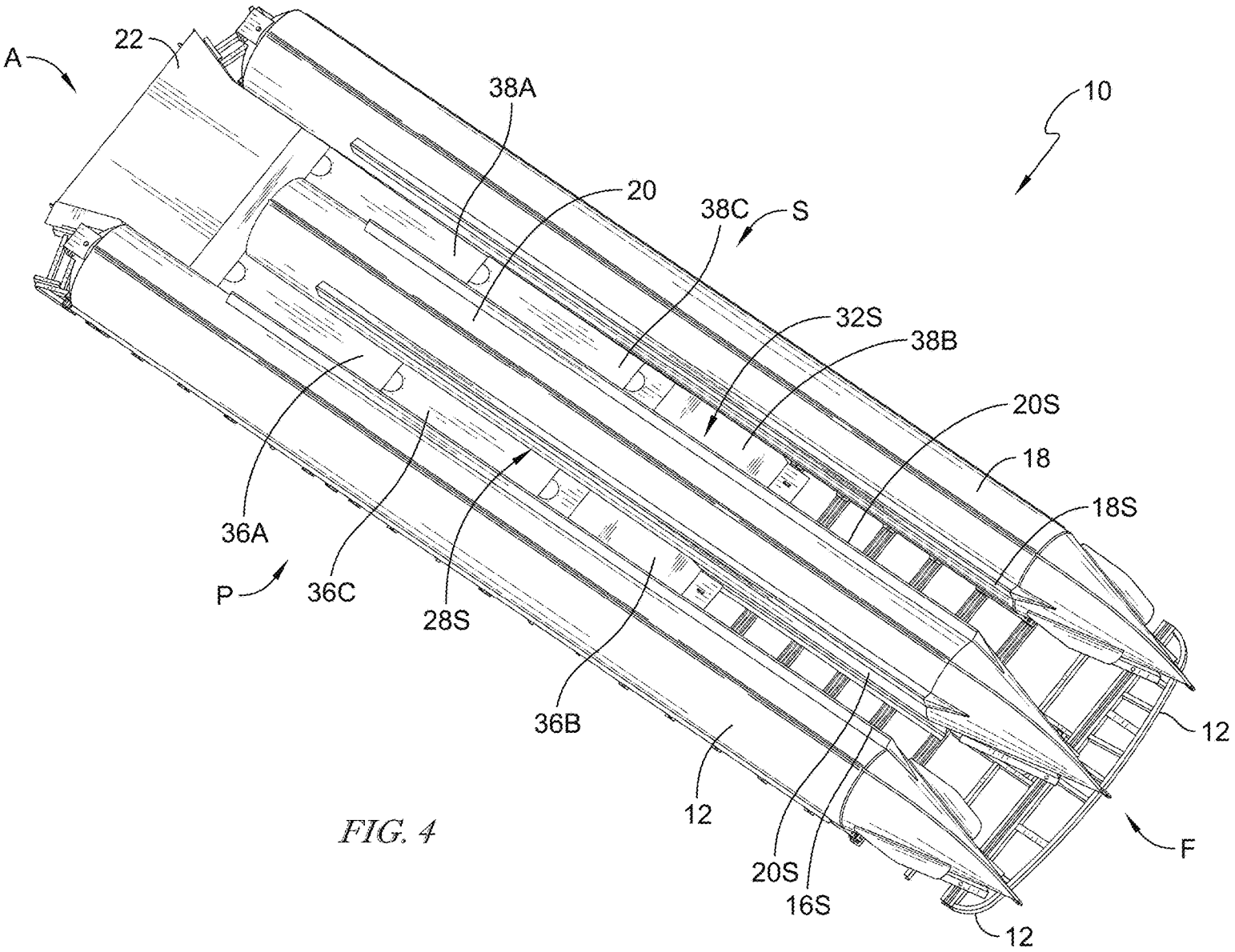
FIG. 4 is a lower front perspective view of the pontoon boat of FIG. 1.
Figure 5:
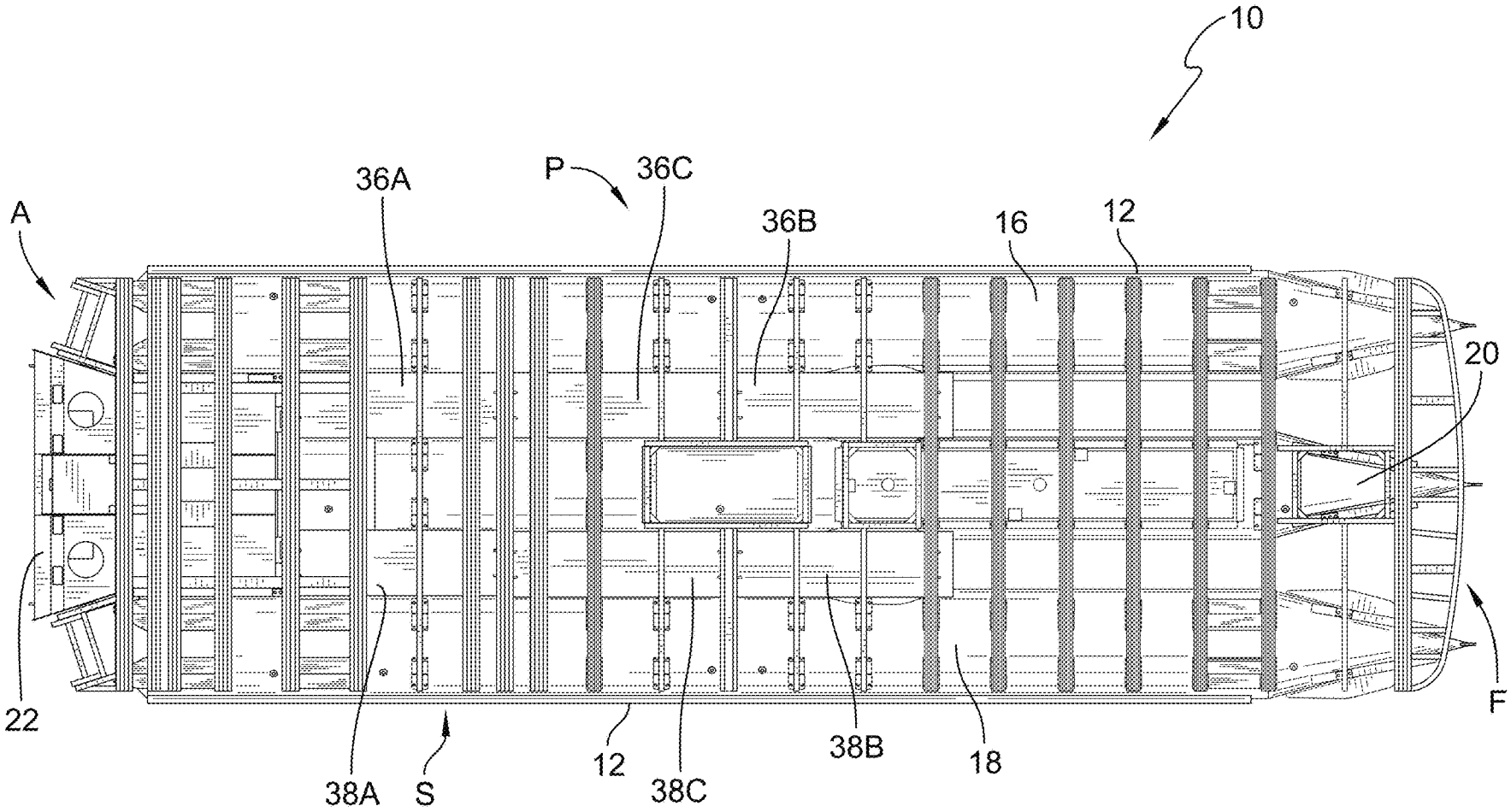
FIG. 5 is a top plan view of the pontoon boat of FIG. 1.
Figure 6:
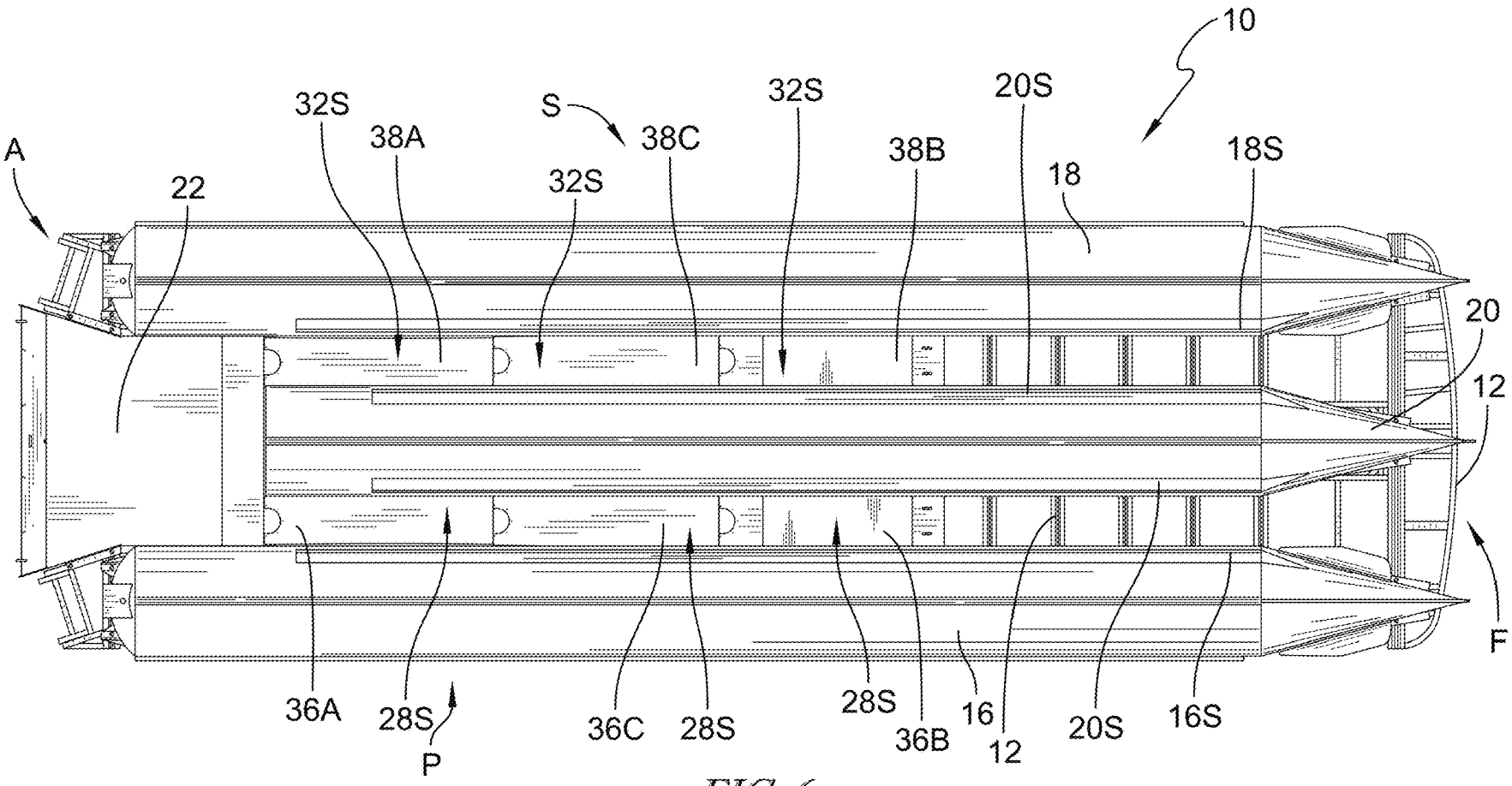
FIG. 6 is a bottom plan view of the pontoon boat of FIG. 1.

Terms used herein defining spatial relationships, for example without limitation, forward, aft, port, starboard, above, below, upper, lower, vertical, horizontal, and the like should be construed in relative terms, rather than absolute terms, unless context clearly dictates otherwise. The term "depth direction" as used herein refers to a downward direction substantially perpendicular to a waterline upon which a boat may float. The term "depth" as used herein refers to a distance in the depth direction relative to the waterline or other reference point.

The drawings show embodiments of an illustrative pontoon boat 10 according to the present disclosure. The pontoon boat 10 has a forward (or bow) end, an aft (or stern) end, a port side, a starboard side, an upper (or top) side, a lower (or bottom) side, and a longitudinal axis or centerline extending through the forward end and the aft end of the pontoon boat 10. In the drawings, the reference characters F, A, P, S, U, and L, respectively, identify the forward (or bow) end, aft (or stern) end, port side, starboard side, upper (or top) side, and lower (or bottom) side of the pontoon boat 10 and components thereof, as discussed further below.

The pontoon boat 10 includes a frame 12 having a forward (or bow) end, an aft (or stern) end, a port side, a starboard side, an upper (or top) side, and a lower (or bottom) side. A deck (not shown) having a forward (or bow) end, an aft (or stern) end, a port side, a starboard side, an upper (or top) side, and a lower (or bottom) side may be disposed upon the frame 12. Additional equipment (not shown), for example, seating, deck rails, and a helm, may be disposed upon the deck (not shown), as would be understood by one skilled in the art.

As will be discussed in further detail below, the pontoon boat 10 includes a frame 12, a first pontoon 16 attached to the frame, a second pontoon 18 attached to the frame 12, a motor pod 22 attached to the frame 12, and a first ramp 28 defining a first running surface 28S attached to the frame 12. The first pontoon 16 may have a lowermost extent located at a first depth relative to a reference point on the frame 12. The second pontoon 18 may have a lowermost extent located at a second depth relative to the point on the frame 12. The motor pod 22 may have a lowermost extent located at a third depth relative to the point on the frame 12. The first running surface 28S may have a lowermost extent located at a fourth depth relative to the point on the frame 12. The first and second depths may be, but need not be equal to each other. The third and fourth depths may be, but need not be equal to each other. Each of the first depth and the second depth may be substantially greater than either of the third depth and the fourth depth. The pontoon boat 10 may further include an optional third pontoon 20 attached to the frame 12. The third pontoon 20 may have a lowermost extent located at a fifth depth relative to the point on the frame 12. One or more strakes may be attached to one or more lower portions of any or all of the first, second, and third pontoons 16, 18, 20. Such strakes may be located at a sixth depth relative to the point on the frame 12.

The first (or port or port-side) pontoon 16 is located underneath and connected to the frame 12 proximate the port side of the frame 12. The port pontoon 16 has a forward (or bow) end, an aft (or stern) end, a port (or outboard) side, a starboard (or inboard) side, an upper (or top) side, and a lower (or bottom) side. As suggested above, the lower side of the first pontoon 16 has a lowermost extent located at the first depth relative to the point on the frame 12.

The second (or starboard or starboard-side) pontoon 18 is located underneath and connected to the frame 12 proximate the starboard side of the frame 12. The starboard pontoon 18 is spaced from and substantially parallel to the port pontoon 16. The starboard pontoon 18 has a forward (or bow) end, an aft (or stern) end, a port (or inboard) side, a starboard (or outboard) side, an upper end, and a lower end. As suggested above, the lower end of the second pontoon 18 has a lowermost extent located at the second depth relative to the point on the frame 12. The second distance may the less than, the same as, or greater than the first distance. As shown, the first and second distance are the same.

As shown, the pontoon boat 10 also includes an optional third (or center) pontoon 20 located underneath and connected to the frame 12. The center pontoon 20 is spaced from, between, and substantially parallel to the port pontoon 16 and the starboard pontoon 18. The center pontoon 20 has a forward (or bow) end, an aft (or stern) end, a port side, a starboard side, an upper end, and a lower end. The center pontoon 20 may be, but need not be, centered between the port pontoon 16 and the starboard pontoon 18. As suggested above, the lower end of the third pontoon 18 has a lowermost extent located at the sixth depth relative to the point on the frame 12. The sixth distance may be less than, the same as, or greater than either or both of the first distance and the second distance. As shown, the sixth distance is the same as the first and second distances. When provided, the center pontoon 20 may be shorter than and not extend as far aft as the port and starboard pontoons 16, 18.

As shown, each of the port pontoon 16, the starboard pontoon 18, and the center pontoon 20 is generally cylindrical, but any or all of the port pontoon 16, the starboard pontoon 18, and the center pontoon 20 could have other general shapes, cross sections, or configurations in other embodiments.

As shown, each of the port, starboard, and center pontoons 16, 18, 20 includes one or more corresponding strakes 16S, 18S, 20S (which may be lifting strakes)ched to a respective outer surface of the respective one of the port, starboard, and center pontoons 16, 18, 20 and extending between respective aft regions thereof and respective forward regions thereof. For example, as shown, the port pontoon 16 includes a strake 16S attached to an outer surface thereof on the starboard side thereof, proximate the bottom thereof, and extending from proximate the aft end thereof to proximate the forward end thereof. Similarly, the starboard pontoon 18 includes a strake 16S attached to an outer surface thereof on the port side thereof, proximate the bottom thereof, and extending from proximate the aft end thereof to proximate the forward end thereof. Also, the center pontoon 20 includes two strakes 16S attached to an outer surface thereof, proximate the bottom thereof, and extending from proximate the aft end thereof to proximate the forward end thereof, wherein one of the strakes 16S is on the port side thereof and the other of the strakes 16S is on the starboard side thereof. As suggested above, each of the strakes 16S, 18S, 20S is located at the fifth depth relative to the point on the frame 12.

The motor pod 22 is attached to the frame 12 proximate the aft end thereof. The motor pod 22 has a forward end, an aft end, a port side, a starboard side, an upper end, and a lower end (or lower surface or bottom). As suggested above, the bottom of the motor pod 22 has a lowermost extent located at the third depth relative to the reference point on the frame 12. The third distance is substantially less than the first distance, the second distance, and the seventh distance.

The aft end of the motor pod 22 defines a transom 24 to which one or more outboard motors 26 may be attached. For example, a single outboard motor 26 may be attached to the transom 24, for example, proximate the center thereof. Alternatively, a first outboard motor 26 may be attached to the transom 24 to port of the center thereof, and a second outboard motor 26 may be attached to the transom 24, for example, to starboard of the center thereof. Each such outboard motor 26 includes a respective propulsor 26P, for example without limitation, a propeller or jet drive (not shown). In embodiments, the motor pod 22 may carry one or more inboard/outboard (I/O) motors (not shown) instead of the one or more outboard motors 26. In such embodiments, such an I/O motor would include a drive unit (not shown) having a propulsor, for example without limitation, a propeller or jet drive (not shown) in a location similar to the location of the propulsor 26P of the outboard motor 26 as shown. The motor pod 22 may be, but need not be, buoyant.

As shown, a forward portion of the motor pod 22 including the forward end thereof is at least nominally narrower than the space defined by the starboard side of an aft portion of the port pontoon 16 and the port side of an aft portion of the starboard pontoon 18. The forward portion of the motor pod 22 including the forward end thereof is disposed between the port pontoon 16 and the starboard pontoon 18 and aft of the optional center pontoon 20. As such, the forward portion of the port side of the motor pod 22 extends toward the starboard side of the port pontoon 16, the forward portion of the starboard side of the motor pod 22 extends toward the port side of the starboard pontoon 18, and the forward end of the motor pod 22 extends toward the aft end of the optional center pontoon 20. As shown, the forward portion of the motor pod 22 is generally rectangular, with the port side of the forward portion of the motor pod 22 parallel to the starboard side of the motor pod 22 and to the port and starboard pontoons 16, 18. In embodiments, the forward portion of the motor pod 22 could be configured in other ways.

As shown, the forward end of the motor pod 22 substantially fills the space defined by the starboard side of the aft portion of the port pontoon 16 and the port side of the aft portion of the starboard pontoon 18. In embodiments, a gap may exist between the port side of the motor pod 22 and the starboard side of the port pontoon 16. Similarly, a gap may exist between the starboard side of the motor pod 22 and the port side of the starboard pontoon 18. These gaps may be left open. In embodiments, at least portions of these gaps may be filled with an isolation pad, for example, a rubber or elastomeric isolation pad, selected to dampen vibration of the motor pod 22 relative to vibration of the port pontoon 16 and/or the starboard pontoon 18. For example, such an isolation pad may be pinched or otherwise provided between the motor pod 22 and the port pontoon 16 and the starboard pontoon 18. In embodiments, at least portions of these gaps may be filled with a non-structural material such as a caulk or putty, that is, a material incapable of attaching the motor pod 22 to the port pontoon 16 or starboard pontoon 18. Similarly, a gap may exist between forward end of the motor pod and the aft end of the center pontoon 20, which gap may be left open or filled, for example, as discussed above. In embodiments, shields (not shown) could be provided to shield these gaps from water flowing underneath the pontoon boat 10 between the port pontoon 16 and the starboard pontoon 18.

In embodiments, the port side of the motor pod 22 may abut the starboard side of the port pontoon 16 without being attached thereto. Similarly, the starboard side of the motor pod 22 may abut the port side of the starboard pontoon 18 without being attached thereto. Also, the forward end of the motor pod 22 may abut the aft end of the optional center pontoon 20 without being attached thereto.

In further embodiments, the motor pod 22 could be attached to any or all of the port pontoon 16, the starboard pontoon 18, and the optional center pontoon 20. For example, the port side of the motor pod 22 could be attached to the starboard side of the port pontoon 16, the starboard side of the motor pod 22 could be attached to the port side of the starboard pontoon 18, and the forward end of the motor pod 22 could be attached to the aft end of the optional center pontoon 20.

As shown, an aft portion of the motor pod 22 including the transom 24 extends aft of the aft ends of the port pontoon 16 and the starboard pontoon 18. The port side and starboard side of the aft portion of the motor pod 22 flare or taper in a laterally outward direction from the port side and starboard of the forward portion of the motor pod 22 such that the motor pod 22 is widest at the transom 24. As such, the aft portion of the motor pod 22 as viewed from above or below is generally trapezoidal. In embodiments, the aft portions of the motor pod 22 as viewed from above or below could take other shapes. For example, the port side and the starboard side of the aft portion of the motor pod 22 are shown as planar, but they could take other shapes. In embodiments, the aft end of the motor pod 22 could be the same width as the forward end of the motor pod 22.

As shown, the lower end of the motor pod 22 extends downwardly to a depth (the third depth) about the longitudinal centerline of at least one of the port pontoon 16, the starboard pontoon 18 and the optional center pontoon 20. In embodiments, the lower end of the motor pod 22 may extend downwardly to a greater or lesser depth. For example, the lower end of the motor pod 22 may extend downwardly to a depth no lower than 10% of the height of the port pontoon 16 and/or starboard pontoon 18 measured, respectively, from the lower end of the port pontoon 16 and/or starboard pontoon 18 to the upper end of the port pontoon 16 and/or the starboard pontoon 18. In embodiments, the depth of the lower end of the motor pod is selected so that the motor pod 22 channels the water flowing underneath the pontoon boat 10 between the port pontoon 16 and the starboard pontoon 18 to a depth (with respect to the frame 12) proximate the respective propulsors 26P of each of the one or more outboard motors 26, and away from the respective midsections 26M of each of the one or more outboard motors 26 attached to the transom 24.

As shown, the aft portion of the motor pod 22 including the transom 24 is wider than the space between the starboard side of the port pontoon 16 and the port side of the starboard pontoon 18. In embodiments, the transom 24 may be narrower than the space between the starboard side of the port pontoon 16 and the port side of the starboard pontoon 18, and a portion of the motor pod 22 forward of the transom 24 (that is, between the aft end of the motor pod 22 and the forward end of the motor pod 22) may be wider than the than the space between the starboard side of the port pontoon 16 and the port side of the starboard pontoon 18.

In embodiments, either the transom 24 or the motor pod 22 in its entirety could be as wide as or nominally narrower than the space between the starboard side of the port pontoon 16 and the port side of the starboard pontoon 16, for example, the same width as the forward portion of the motor pod 22. In such embodiments, the width of the motor pod 22 would be selected so that the motor pod 22 channels the water flowing underneath the pontoon boat 10 between the port pontoon 16 and the starboard pontoon 18 to a depth (with respect to the frame 12) proximate the respective propulsors 26P of each of the one or more outboard motors 26, and/or away from the respective midsections 26M of each of the one or more outboard motors 26 attached to the transom 24.

In embodiments, the motor pod 22 in its entirety may be aft of the aft ends of the port pontoon 16, the starboard pontoon 18, and the optional center pontoon 20. In such embodiments, the motor pod 22 may be wider than, substantially the same width as, or nominally narrower than the space between the starboard side of port pontoon 16 and the port side of the starboard pontoon 18. In such embodiments, the width of the motor pod 22 would be selected so that the motor pod 22 channels the water flowing underneath the pontoon boat 10 between the port pontoon 16 and the starboard pontoon 18 to a depth (with respect to the frame 12) proximate the respective propulsors 26P of each of the one or more outboard motors 26, and/or away from the respective midsections 26M of each of the one or more outboard motors 26 attached to the transom 24.

As shown, the bottom of the motor pod 22 defines a planar surface. As shown, this planar surface is parallel to a longitudinal centerline of the first pontoon 16, the second pontoon 18, and/or the third pontoon 20. In embodiments, at least a portion of this planar surface may be or inclined upwardly or downwardly in a forward-to-aft direction with respect to the plane defined by the longitudinal centerline of the first pontoon 16, the second pontoon 18, and/or the third pontoon 20. For example, without limitation, the forward end of the bottom of the motor pod 22 may be located at or about the fourth depth, and the aft end of the bottom of the motor pod 22 may be located at the third depth. As such, the lower end of the motor pod 22 may function as a trim tab configured to influence the attitude of the pontoon boat 10 with respect to the water surface underneath the pontoon boat 10 when the pontoon boat 10 is in operation. Also, the bottom of the motor pod 22 may provide lift when the pontoon boat 10 is in operation. In embodiments, the lower end of the motor pod 22 could be configured other than planar. For example, the lower end of the motor pod 22 could have having a single or compound V-shape as viewed from the forward or aft end thereof.

As shown, and as mentioned above, the motor pod 22 is configured to channel water flowing under the motor pod 20 to a depth proximate a propulsor 26 of each outboard motor 26. In embodiments having an outboard motor 26 including an anti-ventilation plate (AVP), the motor pod 22 may be configured to channel water flowing under the motor pod 22 predominantly below the AVP. In embodiments including one or more strakes 16S, 18S, 20S, any or all of the strakes 16S, 18S, 20S may be at a lower depth than the lowermost surface of the motor pod 22.

A first ramp 28 is connected to the frame 12 forward of the forward end of the motor pod 22 and between the port pontoon 16 and the center pontoon 20. The first ramp 28 has a forward (or bow) end, an aft (or stern) end, a port side, a starboard side, and a lower (or bottom) surface. The bottom surface of the first ramp 28 defines a first inclined running surface 28S having a forward (or bow) end, an aft (or stern) end, a port side, a starboard side.

The aft end of the first ramp 28 is proximate the forward end of the motor pod 22, adjacent thereto or in abutment therewith. As such, the aft end of the first ramp 28 may be, but need not be, spaced from the forward end of the motor pod 22, thereby defining a gap between the aft end of the first ramp 28 and the forward end of the motor pod 22. Such a gap may be filled, for example, as discussed above in connection with the filling of gaps between the motor pod 22 and the port, starboard, and center pontoons 16, 18, 20.

Similarly, at least a portion of the first ramp 28 may be adjacent to or in abutment with the port pontoon 16, thereby defining a gap between the first ramp 28 and the port pontoon 16. Such a gap may be filled, for example, as discussed above in connection with the filling of gaps between the motor pod 22 and the port, starboard, and center pontoons 16, 18, 20.

Likewise, at least a portion of the first ramp 28 may be adjacent to or in abutment with the center pontoon 20, thereby defining a gap may exist between the first ramp 28 and the center pontoon 20. Such a gap may be filled, for example, as discussed above in connection with the filling of gaps between the motor pod 22 and the port, starboard, and center pontoons 16, 18, 20.

In embodiments, the aft end of the first inclined running surface 28S extends downwardly from the frame 12 to about the same depth as does the forward end of the motor pod 22 so as to mitigate disruption of the flow of water under the first inclined running surface 28S and the motor pod 22 that may be caused by the transition therebetween when the pontoon boat 10 is in forward motion. The first inclined running surface 28S extends in forward and upward directions from proximate the aft end thereof to proximate the forward end thereof. As shown, the first inclined running surface 28S extends forward to proximate the midpoint of the frame 12. In embodiments, the first inclined running surface 28S may extend forward farther than proximate the midpoint of the frame 12, for example to proximate the forward portion of the frame 12. As shown, the first inclined running surface 28S extends upward to proximate the lower side of the frame 12. In embodiments, the first inclined running surface 28S may extend upward a lesser distance.

The first inclined running surface 28S may be embodied as a surface of a single structure or as surfaces of two or more discrete structures, one in front of the other and/or one beside the other. In embodiments, the first inclined running surface 28S may be embodied as a lower surface of a first flotation pod that may be embodied in one or more discrete sections, as will be discussed further below.

An optional first belly skin (not shown) may extend forward from the forward end of the first inclined running surface 28S toward the forward end of the frame 12. The first belly skin (not shown), if provided, may assist in inhibiting introduction of water between the first inclined running surface 28S and the frame 12 of the pontoon boat 10. The first inclined running surface 28S is configured to channel water flowing between the port pontoon 14 and the center pontoon 20 underneath the motor pod 22 and toward the propulsor(s) 26P of the outboard motor(s) 26.

A second ramp 32 is connected to the frame 12 forward of the forward end of the motor pod 22 and between the starboard pontoon 18 and the center pontoon 20. The second ramp 32 has a forward (or bow) end, an aft (or stern) end, a port side, a starboard side, and a lower (or bottom) surface. The bottom surface of the second ramp 32 defines a second inclined running surface 32S having a forward (or bow) end, an aft (or stern) end, a port side, and a starboard side.

The aft end of the second ramp 32 is proximate the forward end of the motor pod 22, adjacent thereto or in abutment therewith. As such, the aft end of the second ramp 32 may be, but need not be, spaced from the forward end of the motor pod 22, thereby defining a gap between the aft end of the second ramp 32 and the forward end of the motor pod 22. Such a gap may be filled, for example, as discussed above in connection with the filling of gaps between the motor pod 22 and the port, starboard, and center pontoons 16, 18, 20.

Similarly, at least a portion of the second ramp 32 may be adjacent to or in abutment with the starboard pontoon 18, thereby defining a gap between the second ramp 32 and the starboard pontoon 18. Such a gap may be filled, for example, as discussed above in connection with the filling of gaps between the motor pod 22 and the port, starboard, and center pontoons 16, 18, 20.

Likewise, at least a portion of the second ramp 32 may be adjacent to or in abutment with the center pontoon 20, thereby defining a gap may exist between the second ramp 32 and the center pontoon 20. Such a gap may be filled, for example, as discussed above in connection with the filling of gaps between the motor pod 22 and the port, starboard, and center pontoons 16, 18, 20.

In embodiments, the aft end of the second inclined running surface 32S extends downwardly from the frame 12 to about the same depth as does the forward end of the motor pod 22 so as to mitigate disruption of the flow of water under the second inclined running surface 32S and the motor pod 22 that may be caused by the transition therebetween when the pontoon boat 10 is in forward motion. The second inclined running surface 32S extends in forward and upward directions from proximate the aft end thereof to proximate the forward end thereof. As shown, the second inclined running surface 32S extends forward to proximate the midpoint of the frame 12. In embodiments, the second inclined running surface 32S may extend forward farther than proximate the midpoint of the frame 12, for example to proximate the forward portion of the frame 12. As shown, the second inclined running surface 32S extends upward to proximate the lower side of the frame 12. In embodiments, the second inclined running surface 32S may extend upward a lesser distance.

The second inclined running surface 32S may be embodied as a surface of a single structure or as surfaces of two or more discrete structures, one in front of the other and/or one beside the other. In embodiments, the second inclined running surface 32S may be embodied as a lower surface of a second flotation pod that may be embodied in one or more discrete sections, as will be discussed further below.

An optional second belly skin (not shown) extends forward from the forward end of the second inclined running surface 32S toward the forward end of the frame 12. The second belly skin (not shown), if provided, may assist in inhibiting introduction of water between the second inclined running surface 32S and the frame 12 of the pontoon boat 10. The second inclined running surface 32S is configured to channel water flowing between the port pontoon 14 and the center pontoon 20 underneath the motor pod 22 and toward the propulsor(s) 26P of the outboard motor(s) 26.

In embodiments omitting the optional center pontoon 20, the second ramp 32 and the second inclined running surface 32S may be omitted, as well. In such embodiments, the first inclined running surface 28 (and the first belly skin (not shown), if provided) may extend laterally (in a port-to-starboard direction) between the starboard side of the port pontoon 16 and the port side of the starboard pontoon 18. In such embodiments, at least a portion of the first inclined running surface 28 may be adjacent to or in abutment with one or both of the port pontoon 16 and the starboard pontoon 18. Gaps between the first inclined running surface 28 and either or both of the port and starboard pontoons 16, 18, may be filled, for example, as discussed above in connection with the filling of gaps between the motor pod and the port, starboard, and center pontoons 16, 18, 20.

The port pontoon 16, the center pontoon 20, the first inclined running surface 28S, and the optional first belly skin (not shown) cooperate to define a first water channel extending between the port pontoon 16 and the center pontoon 20, and below the first inclined running surface 28S and the optional first belly skin (not shown). The starboard pontoon 18, the center pontoon 20, the second inclined running surface 32S, and the optional second belly skin (not shown) cooperate to define a second water channel extending between the starboard pontoon 18 and the center pontoon 20, and below the second inclined running surface 32S and the optional second belly skin (not shown). In embodiments omitting the optional center pontoon 20, the port pontoon 16, the starboard pontoon 18, the first inclined running surface 28S, and the optional first belly skin 30 cooperate to define a water channel between the port pontoon 16 and the starboard pontoon 18, and below the first inclined running surface 28S and the optional first belly skin (not shown).

The port pontoon 16, the center pontoon 20, the first inclined running surface 28, and the optional first belly skin (not shown) cooperate with the motor pod 22 to channel or otherwise direct water flowing through the first water channel under the motor pod 22, toward the propulsor 26P of a corresponding outboard motor 26 attached to the transom 24 aft of the first water channel, and away from midsections 26M of the corresponding outboard motor 26, regardless of whether the corresponding outboard motor 26 is oriented to propel the pontoon boat 10 in a purely forward direction or pivoted (including maximally pivoted) to propel the pontoon boat 10 in a port or starboard direction.

Similarly, the starboard pontoon 18, the center pontoon 20, the second inclined running surface 32, and the optional second belly skin (not shown) cooperate with the motor pod 22 to channel or otherwise direct water flowing through the second water channel under the motor pod 22, toward the propulsor 26P of a corresponding outboard motor 26 attached to the transom 24 aft of the first water channel, and away from midsections 26M of the corresponding outboard motor 26, regardless of whether the corresponding outboard motor 26 is oriented to propel the pontoon boat 10 in a purely forward direction or pivoted (including maximally pivoted) to propel the pontoon boat 10 in a port or starboard direction.

In embodiments omitting the optional center pontoon 20, the port pontoon 16, the starboard pontoon 18, the first inclined running surface 28, and the optional first belly skin (not shown) cooperate with the motor pod 22 to channel or otherwise direct water flowing through the water channel under the motor pod 22, toward respective propulsors 26P of one or more corresponding outboard motors 26 attached to the transom 24 aft of the water channel and away from respective midsections 26M of the one or more outboard motors 26, regardless of whether the one or more outboard motors 26 are oriented to propel the pontoon boat in a purely forward direction or pivoted (including maximally pivoted) to propel the pontoon boat 10 in a port or starboard direction.

In embodiments including one or more strakes 16S, 18S, 20S, any or all of the strakes 16S, 18S, 20S may be at a lower depth than the lowermost surface of the first inclined running surface 28S and the second inclined running surface 32S.

As mentioned above, the first inclined running surface 28S may be embodied as the lower surface of one or more flotation pods. As shown, the first inclined running surface 28S is embodied as the lower surface of a first set of flotation pods 36 including three flotation pods 36*n*. A first (or aft) flotation pod 36A of the first set of flotation pods 36 is located proximate an aft end of the first set of flotation pods 36 and proximate the motor pod 22. A second (or forward) flotation pod 36B of the first set of flotation pods 36 is located proximate a forward end of the first set of flotation pods 36. A third (or intermediate) flotation pod 36C of the first set of flotation pods 36 is located intermediate the first flotation pod 36A and the second flotation pod 36B of the first set of flotation pods 36. As suggested above, the first set of flotation pods 36 could include fewer than three flotation pods (as few as one) or more than three flotation pods 36*n*, for example additional flotation pods 36*n* intermediate the first flotation pod 36A and the second flotation pod 36B of the first set of flotation pods 36.

Similarly, the second inclined running surface 32S may be embodied as the lower surface of one or more flotation pods. As shown, the second inclined running surface 32S is embodied as the lower surface of a second set of flotation pods 38 including three flotation pods 38*n*. A first (or aft) flotation pod 38A of the second set of flotation pods 38 is located proximate an aft end of the second set of flotation pods 38 and proximate the motor pod 22. A second (or forward) flotation pod 38B of the second set of flotation pods 38 is located proximate a forward end of the second set of flotation pods 38. A third (or intermediate) flotation pod 38C of the second set of flotation pods 38 is located intermediate the first flotation pod 38A and the second flotation pod 38B of the second set of flotation pods 38. As suggested above, the second set of flotation pods 38 could include fewer than three flotation pods 38*n* (as few as one) or more than three flotation pods 38*n*, for example additional flotation pods 38*n* intermediate the first flotation pod 38A and the second flotation pod 38B of the second set of flotation pods 38.

The respective flotation pods 36*n*, 38*n* of the first and second sets of flotation pods 36, 38 may be structurally similar to each other, for example, identical to or mirror images of each other. Also, the respective flotation pods 36*n*, 38*n* of the first and second sets of flotation pods 36, 38 may be connected to the pontoon boat 10 in similar manners. As such, the structures of only the flotation pods 36*n* of the first set of flotation pads 36 and the connection of only the flotation pods 36*n* of the first set of flotation pads 36 to the pontoon boat 10 will be discussed in detail herein.

The first set of flotation pods 36 includes a upper side, a lower side, a forward end, an aft end, a port side, and a starboard side. In embodiments, the first set of flotation pods 36 may include a single flotation pod 36*n* defining the upper side, lower side, forward end, aft end, port side, and starboard side of the first set of flotation pods 36. In embodiments including more than one flotation pod 36*n* in the first set of flotation pods 36, for example, as shown, each such flotation pod 36*n* includes a respective upper side, a respective lower side, a respective forward end, a respective aft end, a respective port side, and a respective starboard side. In such embodiments, the respective upper sides, respective lower sides, respective forward ends, respective aft ends, respective port sides, and respective starboard sides of the individual flotation pods 36*n* of the first set of flotation pods 36 cooperate to define the upper side, lower side, forward end, aft end, port side, and starboard side of the first set of flotation pods 36 as an entirety.

FIGS. 23-49 best show in detail illustrative, non-limiting examples of first, second, and third flotation pods 36A, 36B, 36C of a first set of flotation pods 36. As shown in the drawings, the upper side, lower side, forward end, aft end, port side, and starboard side of each flotation pod 36*n* of the first set of flotation pods 36 is embodied as a respective structure having an upper wall 40, a lower wall 42, a forward wall 44, an aft wall 46, a port wall 48, and a starboard wall 50. Notwithstanding, a distinct forward wall 44 may be omitted in the forward-most flotation pod 36*n* of the first set of flotation pods 36 and, instead, the lower wall 42 may taper upward to and join the upper wall 40 proximate respective forward ends thereof. As shown, the forward-most flotation pod 36*n* of the first set of flotation pods 36 is the second flotation pod 36B. In embodiments including a single flotation pod 36*n* in the first set of flotation pods 36, the forward wall 44 may be omitted therefrom.

The foregoing walls 40, 42, 44 (if provided), 46, 48, 50 cooperate to define a generally hollow interior compartment. Generally, the interior compartment is watertight. As such, each of the flotation pods 36*n* of the first set of flotation pods 36 may provide buoyancy to the pontoon boat 10. In embodiments, one of the walls, for example (as shown), the aft wall 46, defining the interior compartment may be provided with a port 56 that may be fitted with a valve (not shown) through which air may be provided to pressurize the interior compartment to verify that it is watertight. The valve (not shown) subsequently may be removed and the port 56 may be plugged with a watertight plug (not shown) to preclude the interior compartment from taking on water. In the event that the interior compartment nevertheless takes on water, for example, due to a breach of one of the walls 40, 42, 44 (if provided), 46, 48, 50, the plug (not shown) may be removed from the port 56 to drain the water from the interior compartment.

Figure 7:
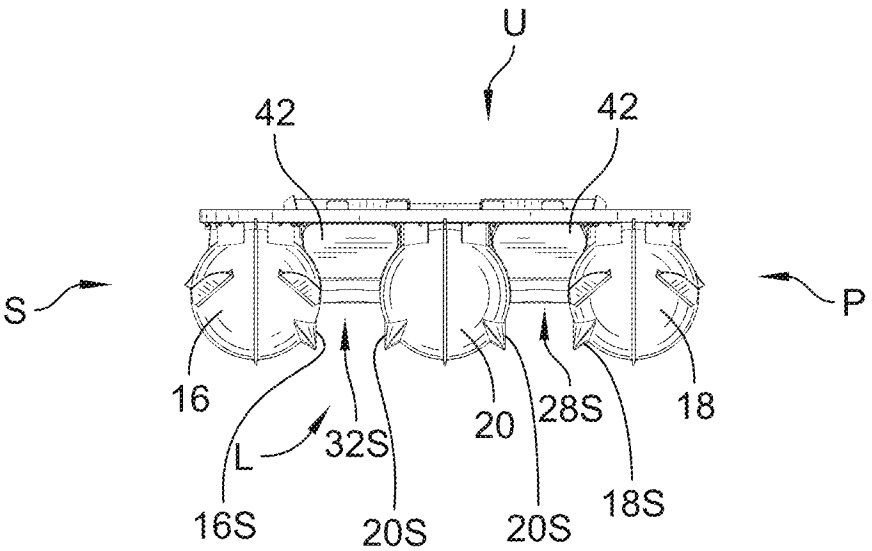
FIG. 7 is a front elevation view of the pontoon boat of FIG. 1.
Figure 8:
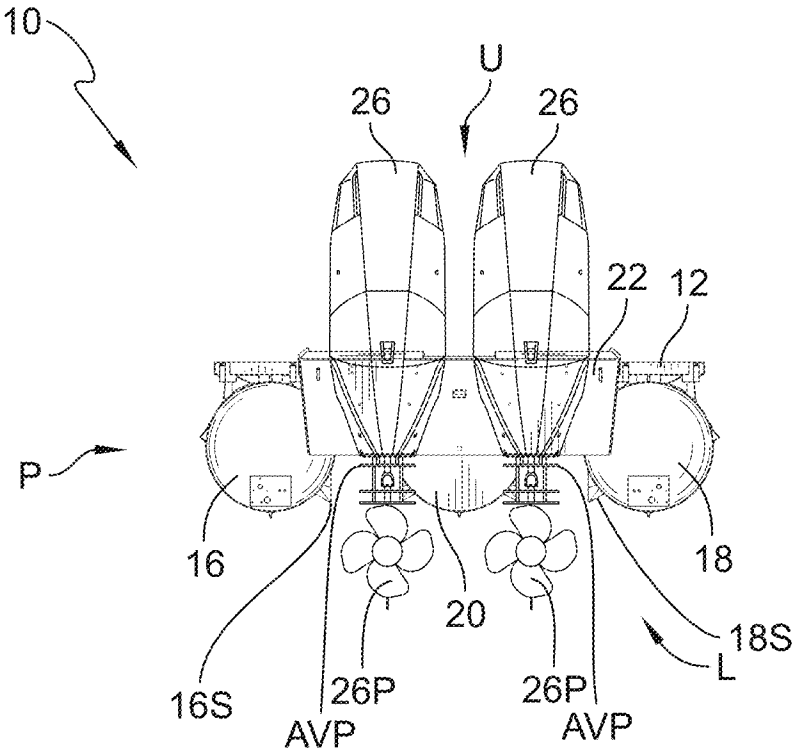
FIG. 8 is an aft elevation view of the pontoon boat of FIG. 1.
Figure 9:
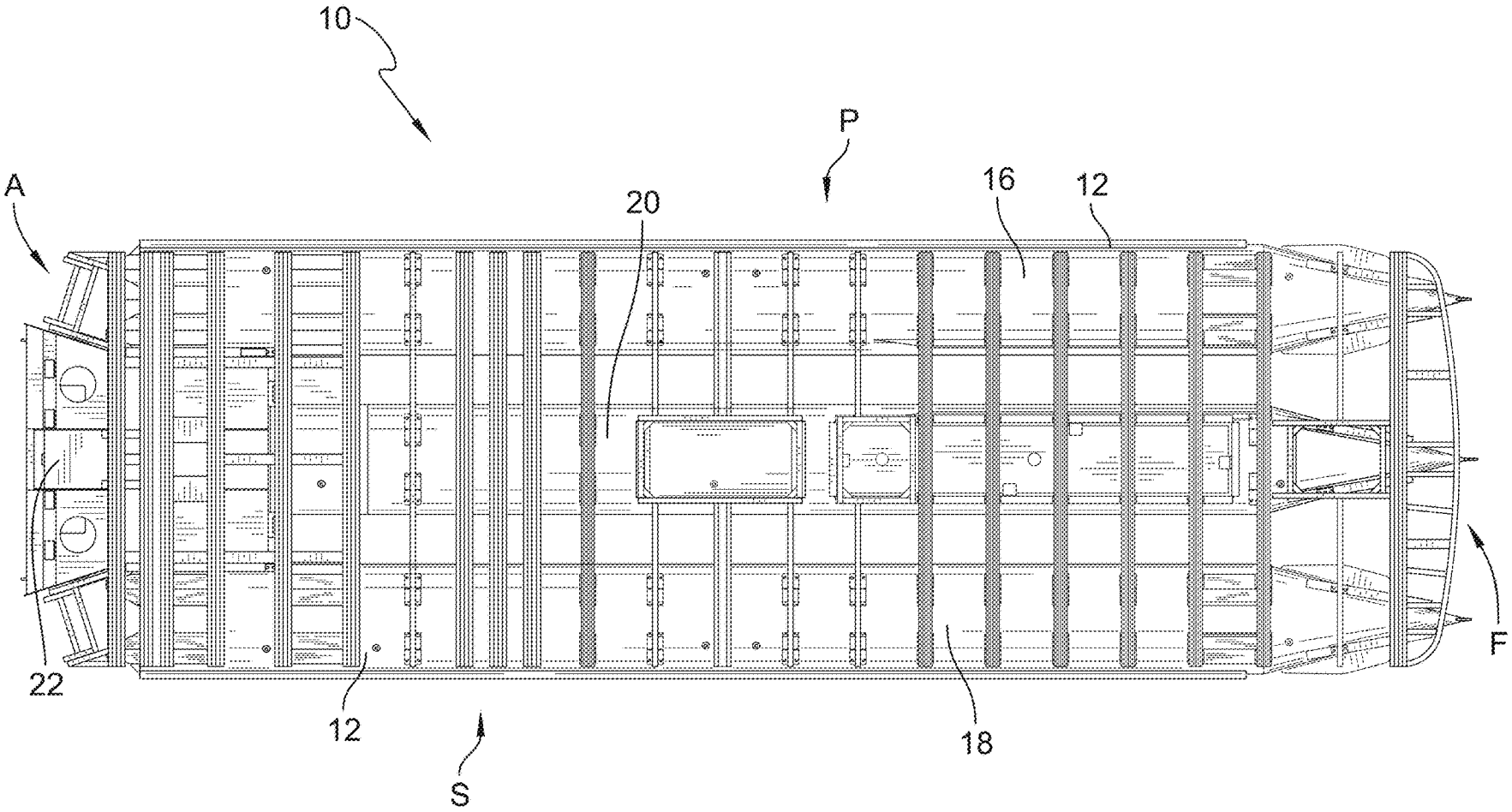
FIG. 9 is a top plan view of the pontoon boat of FIG. 1 with the first and second sets of flotation pods removed.
Figure 10:
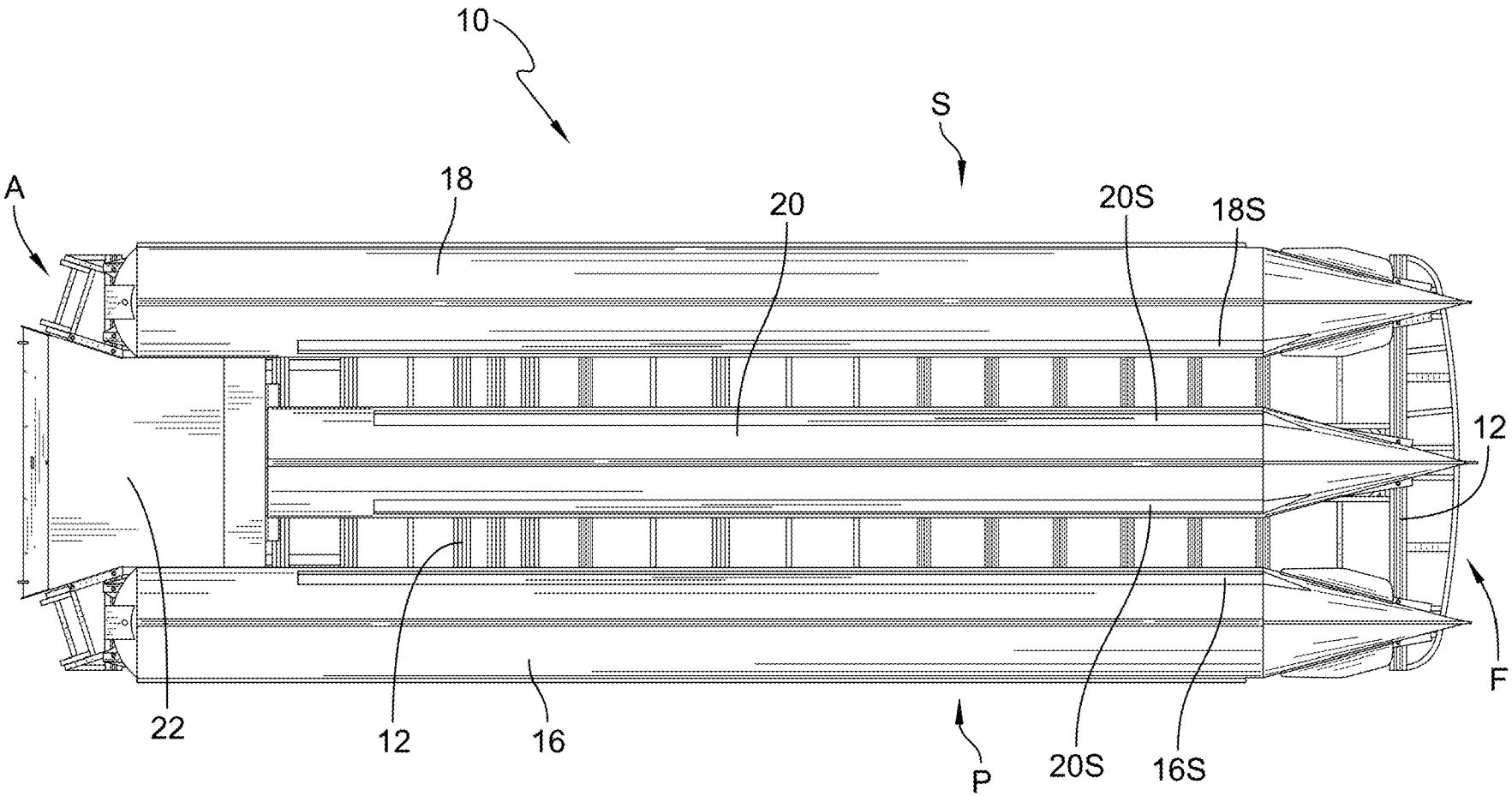
FIG. 10 is a bottom plan view of the pontoon boat of FIG. 9.
Figure 11:
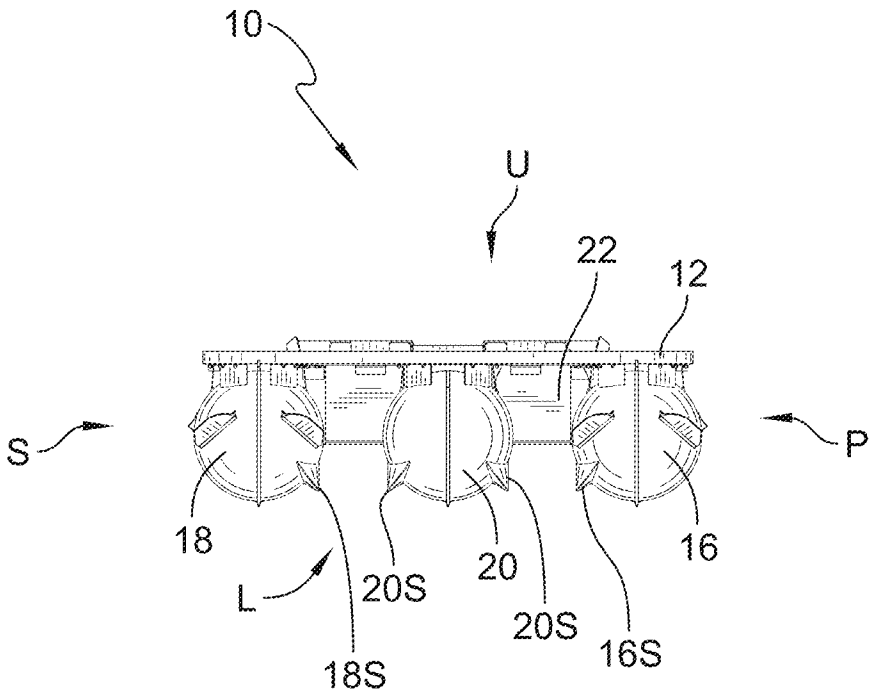
FIG. 11 is a front elevation view of the pontoon boat of FIG. 9.
Figure 12:
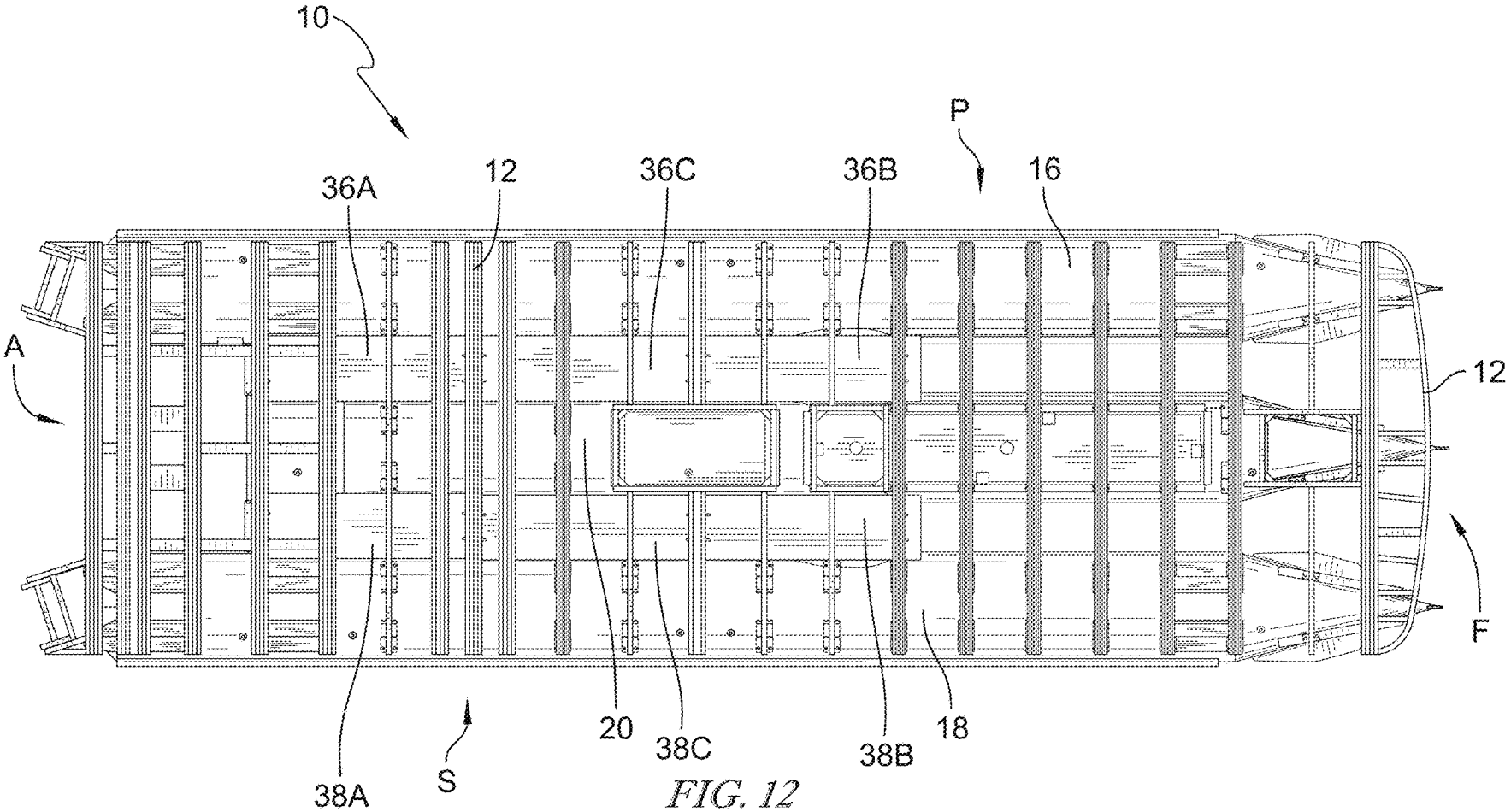
FIG. 12 is a top plan view of the pontoon boat of FIG. 1 with the motor pod removed.
Figure 13:
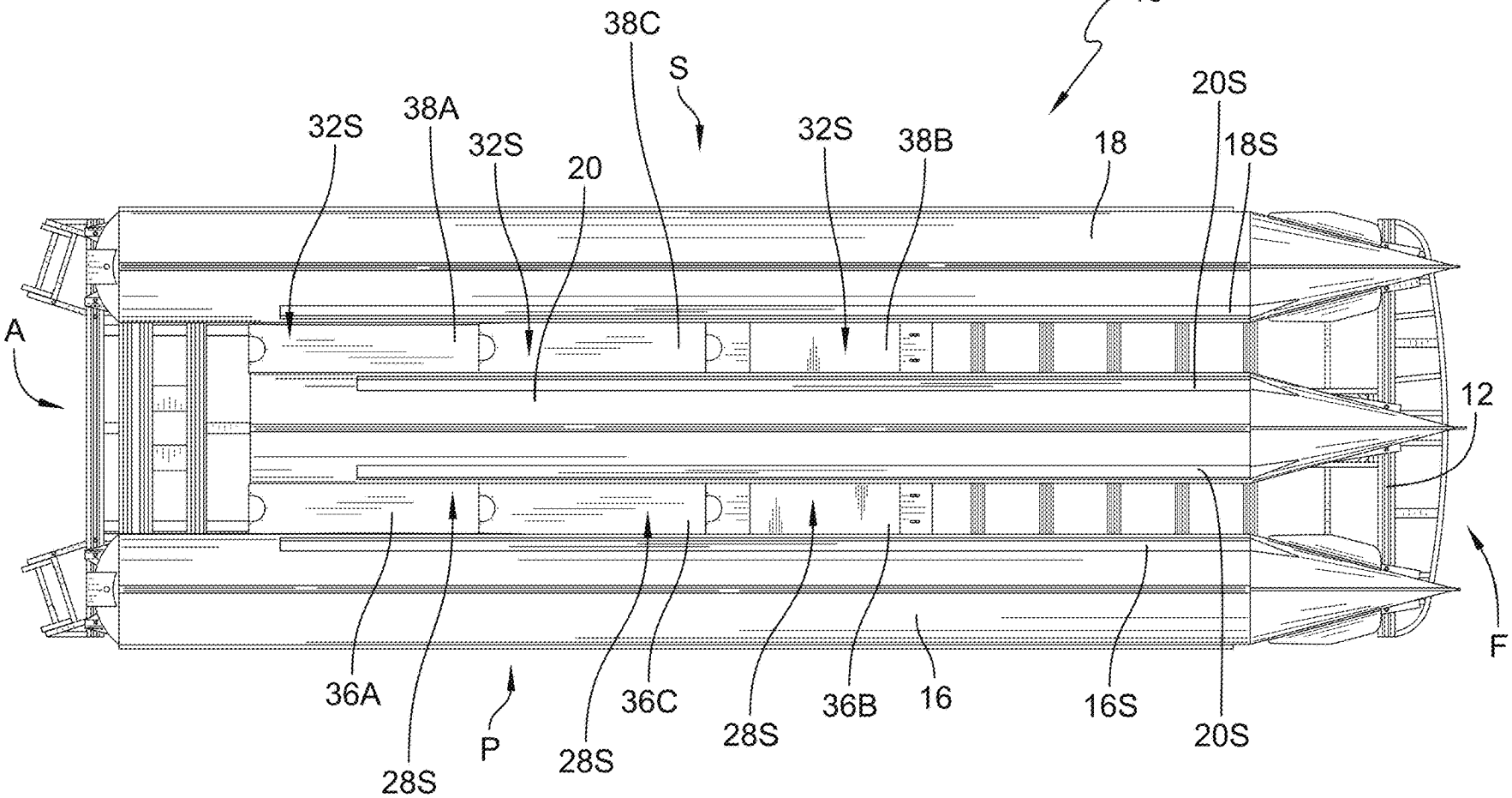
FIG. 13 is a bottom plan view of the pontoon boat of FIG. 12.
Figure 14:
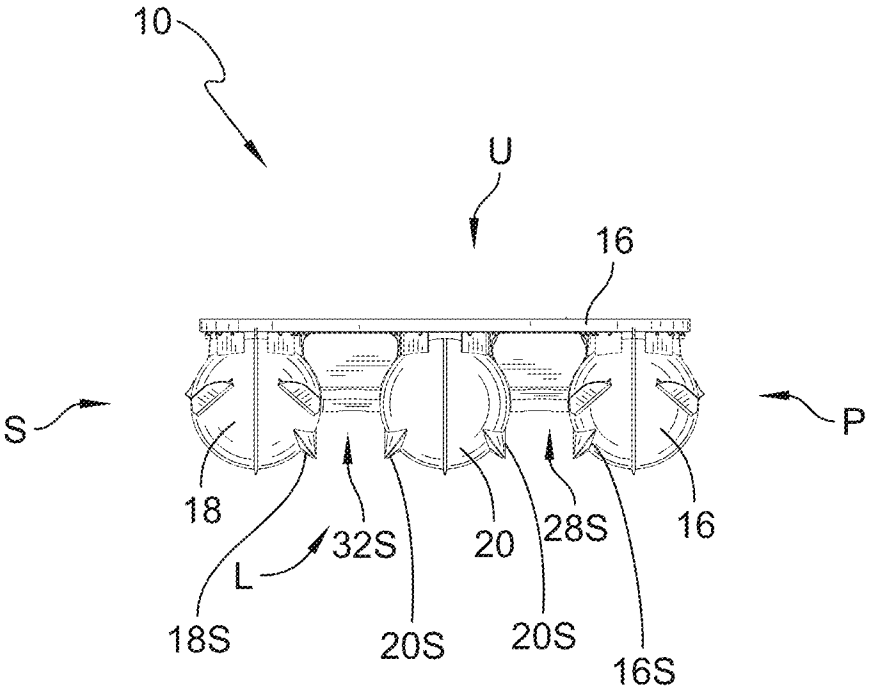
FIG. 14 is a front elevation view of the pontoon boat of FIG. 12.
Figure 15:
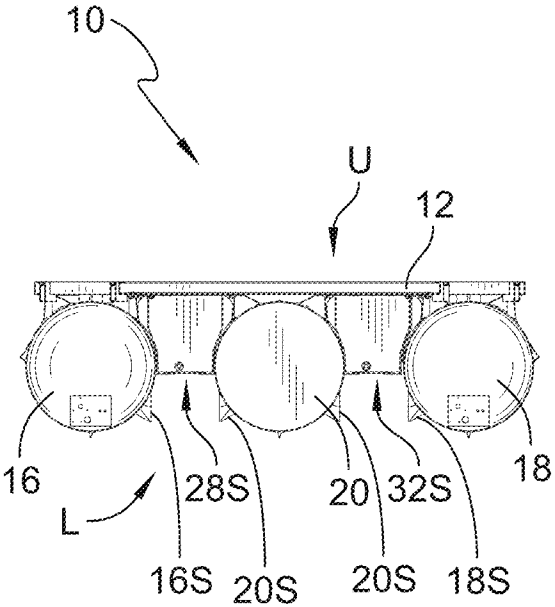
FIG. 15 an aft elevation view of the pontoon boat of FIG. 12.
Figure 16:
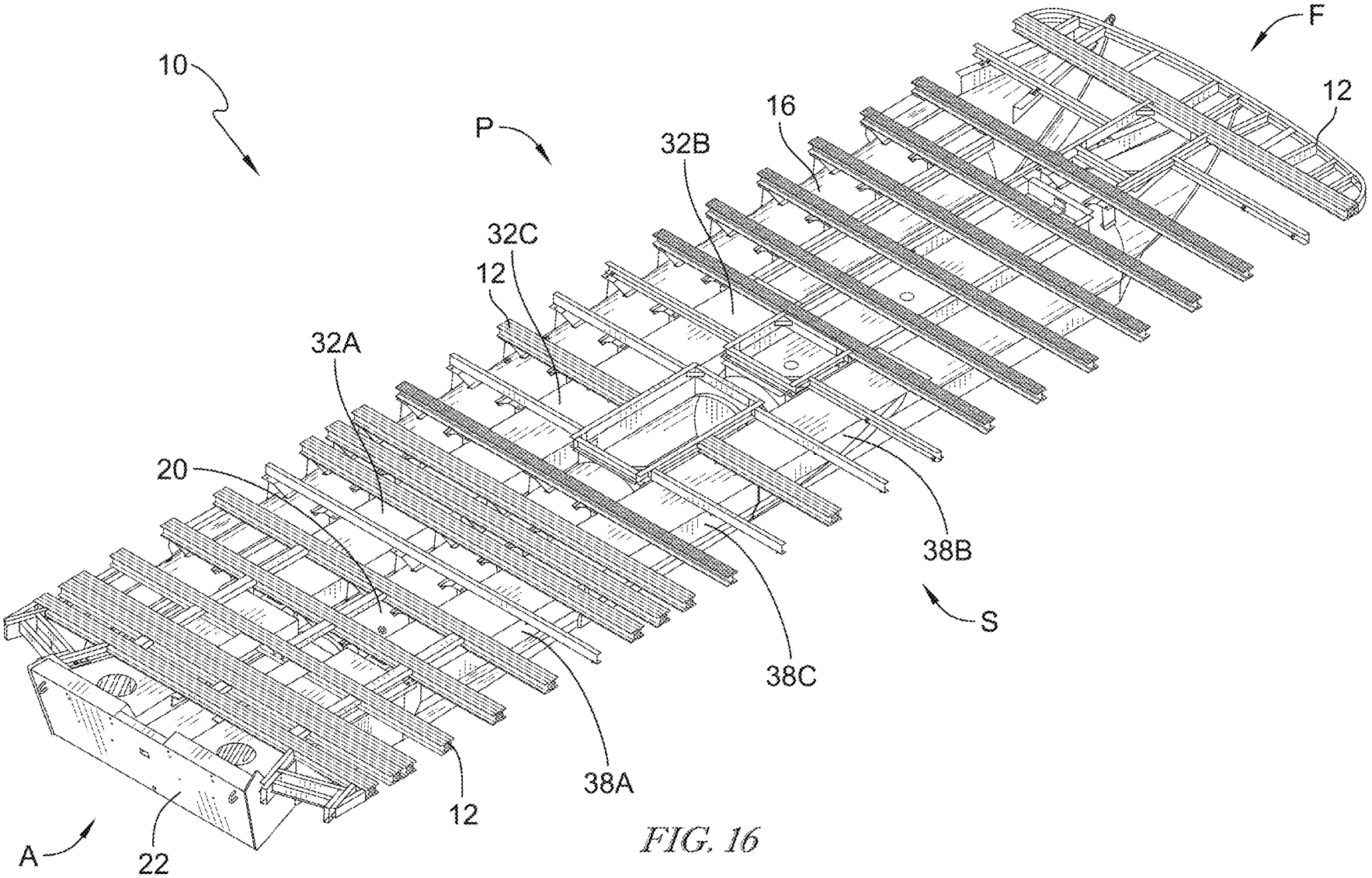
FIG. 16 is an upper aft perspective view of the pontoon boat of FIG. 1 with the second pontoon removed.
Figure 17:
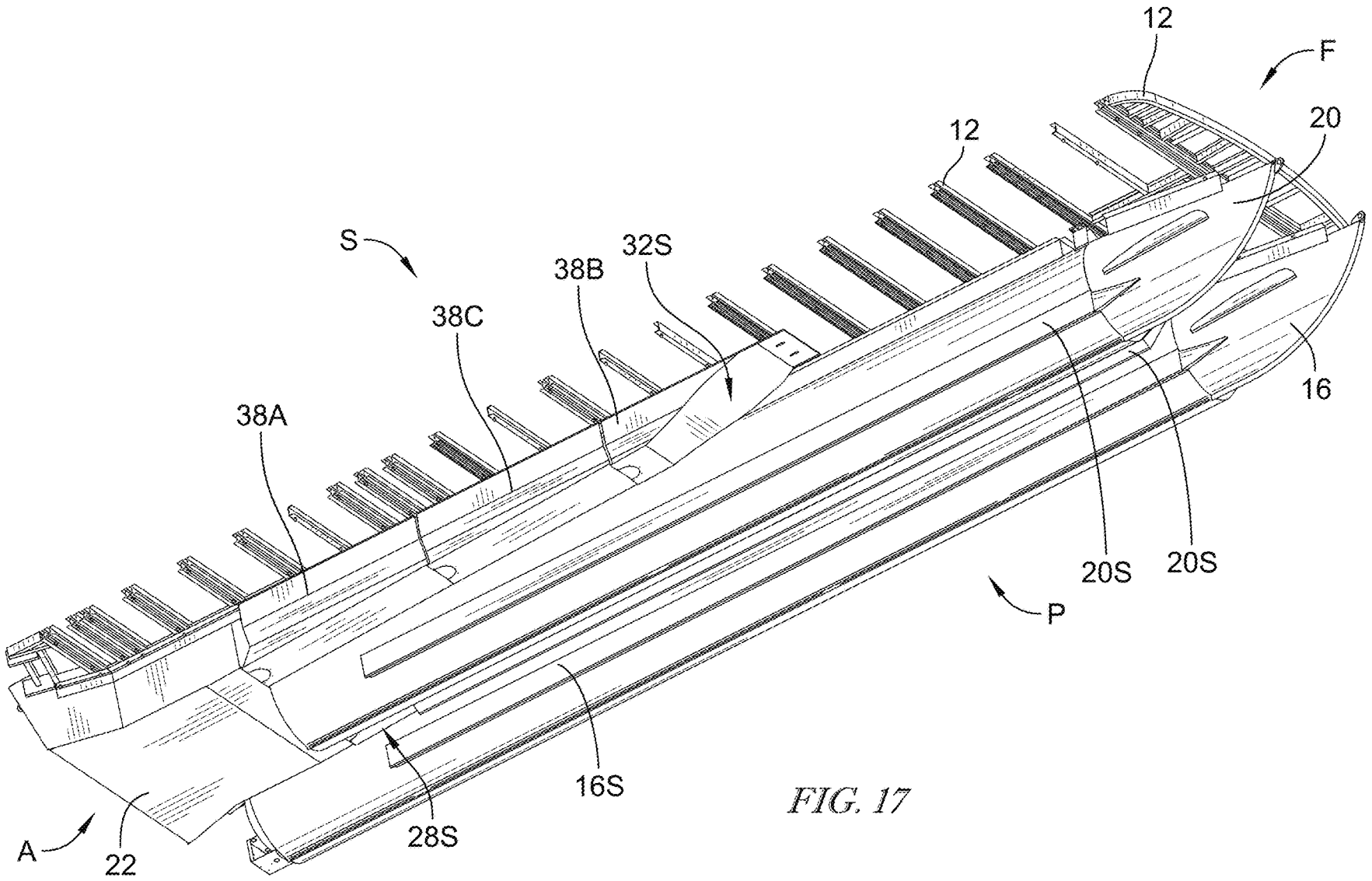
FIG. 17 is a lower front perspective view of the pontoon boat of FIG. 16.
Figure 18:
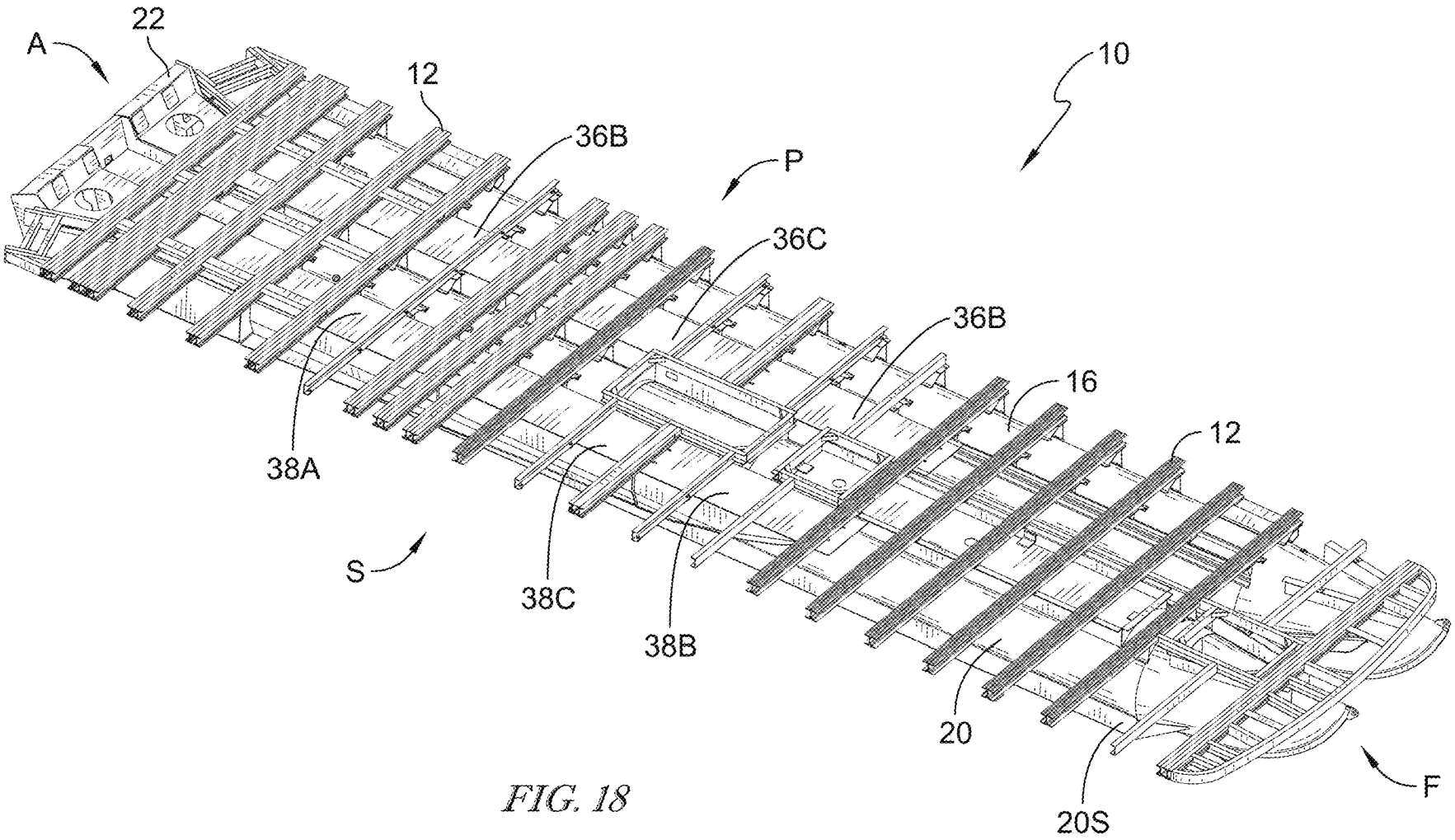
FIG. 18 is an upper front perspective view of the pontoon boat of FIG. 16.
Figure 19:
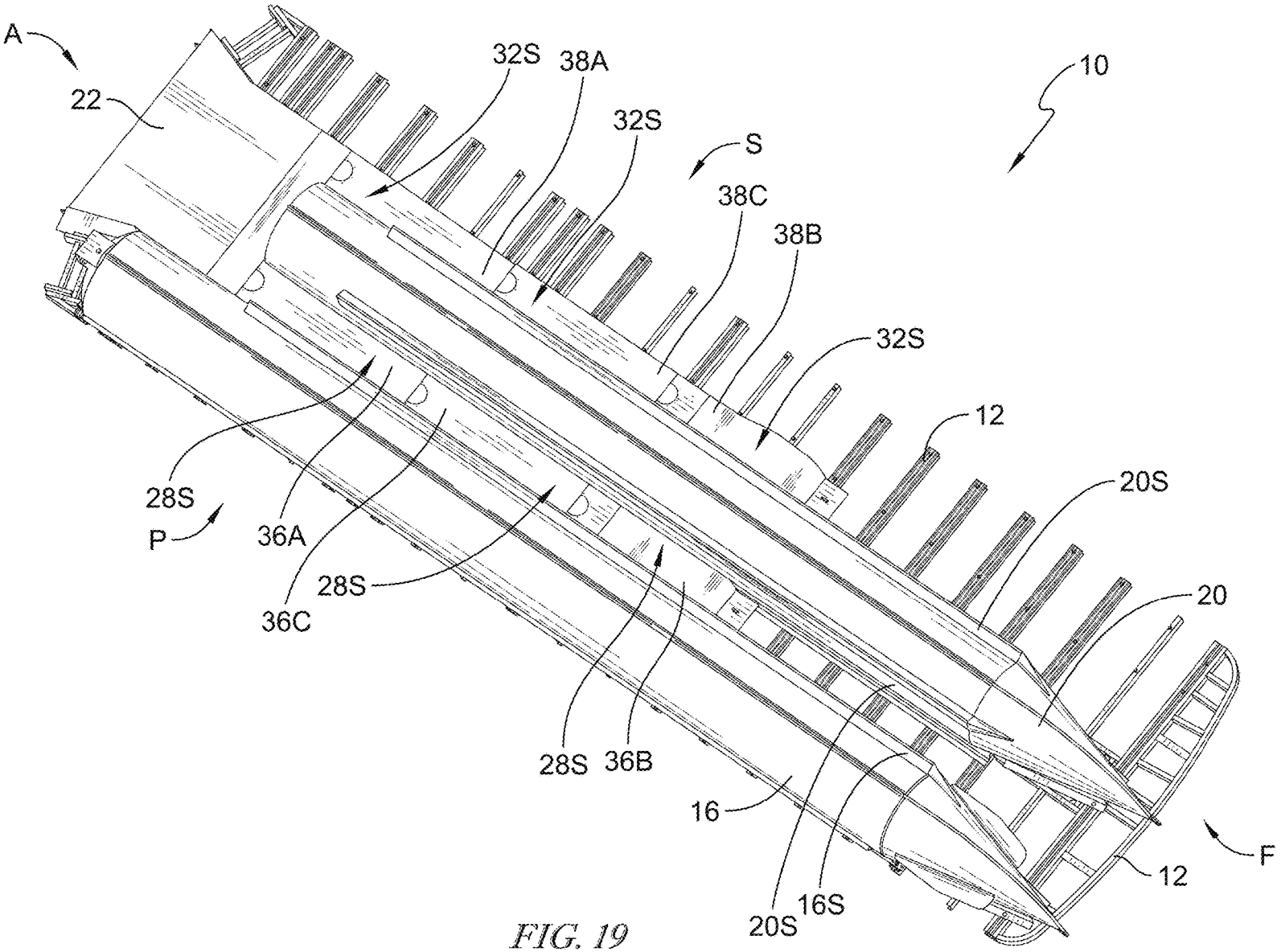
FIG. 19 is a lower perspective view of the pontoon boat of FIG. 16.
Figure 20:
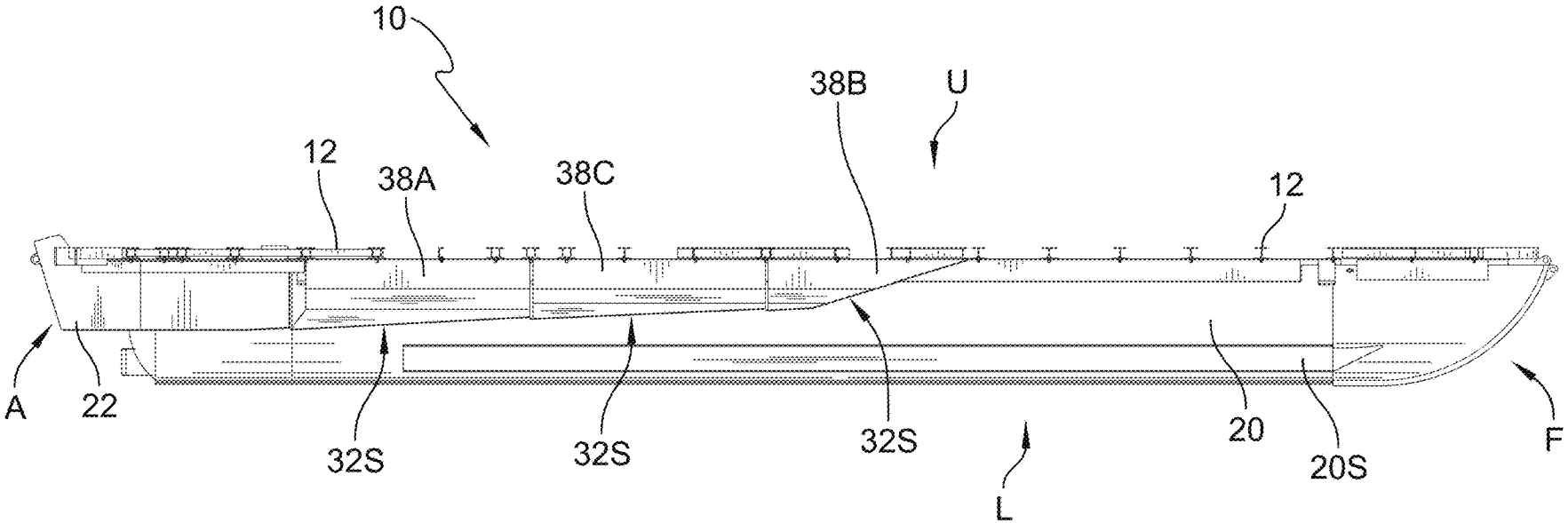
FIG. 20 is a starboard elevation view of the pontoon boat of FIG. 16.
Figure 21:
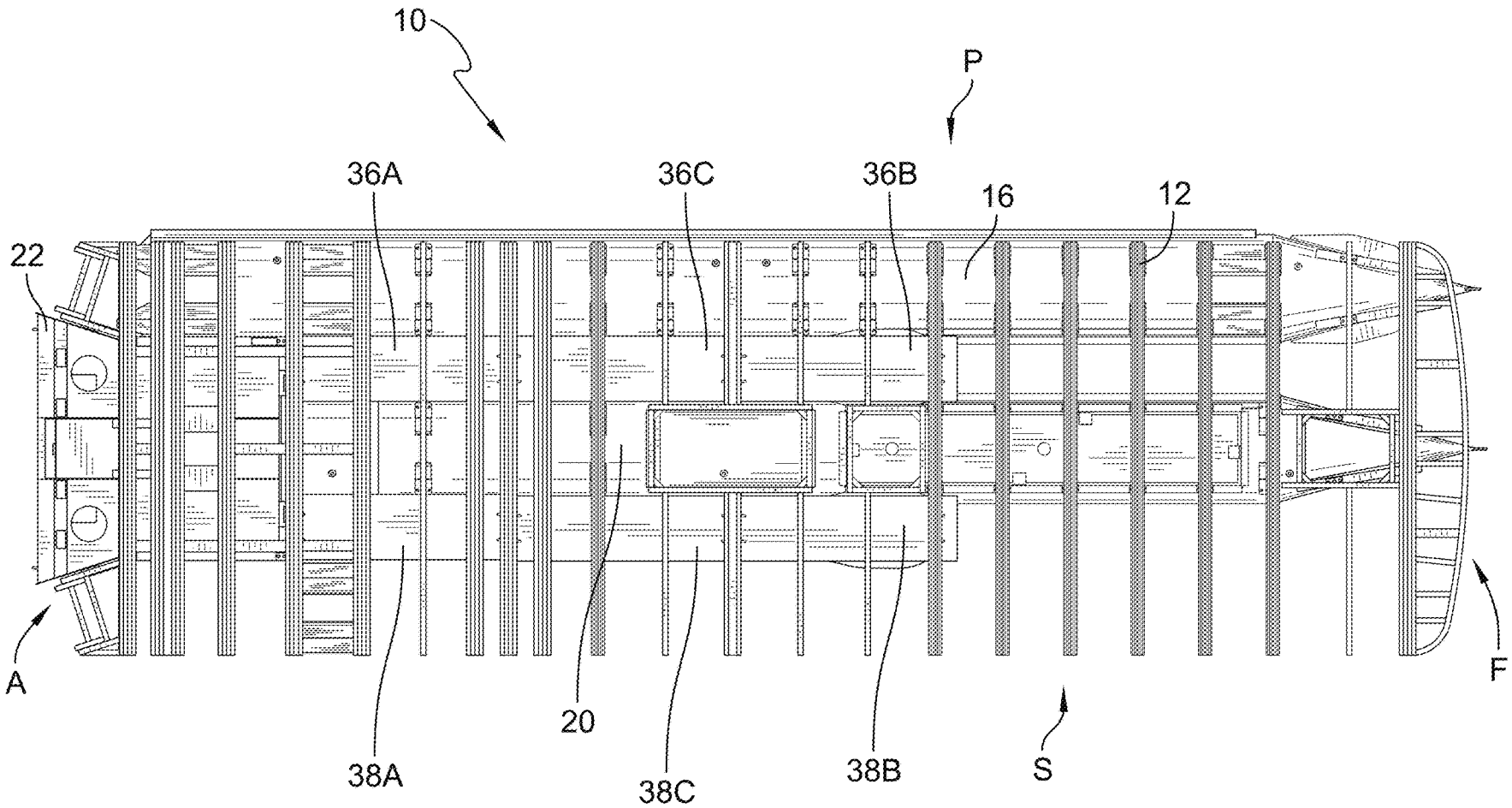
FIG. 21 is a top plan view of the pontoon boat of FIG. 16.
Figure 22:
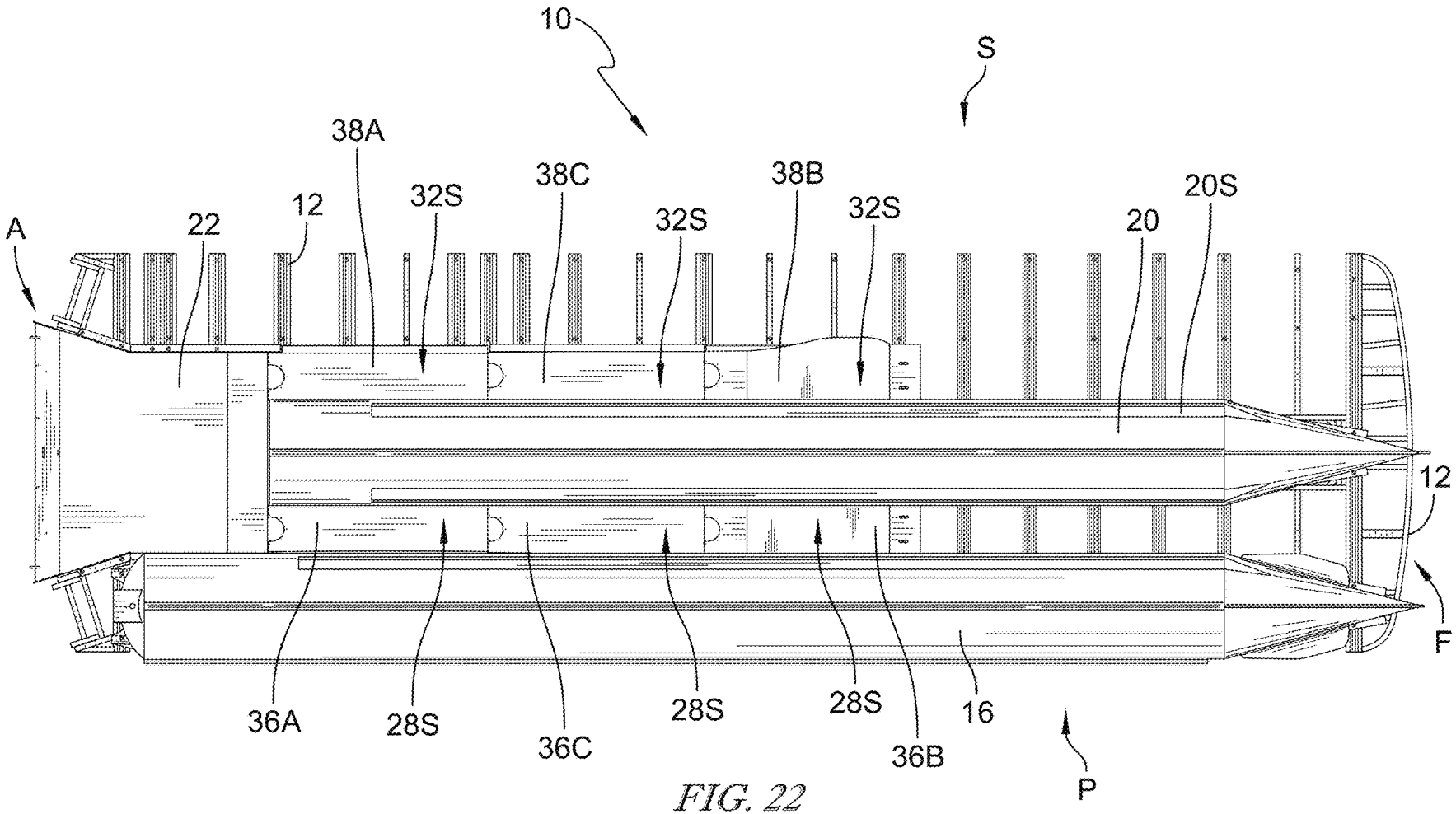
FIG. 22 is a bottom plan view of the pontoon boat of FIG. 16.
Figure 23:
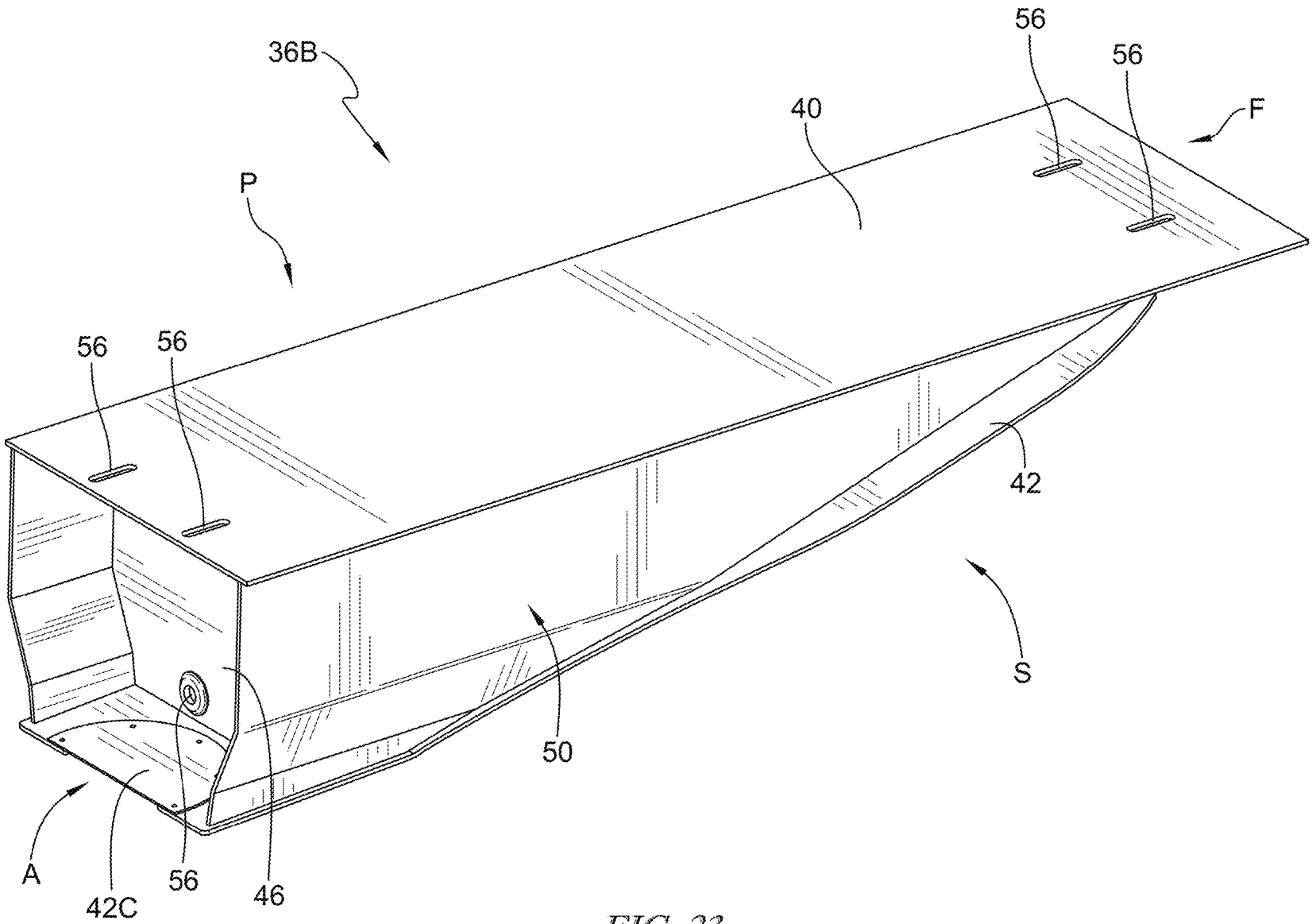
FIG. 23 is an upper, aft, starboard perspective view of an illustrative flotation pod according to the present disclosure.
Figure 24:
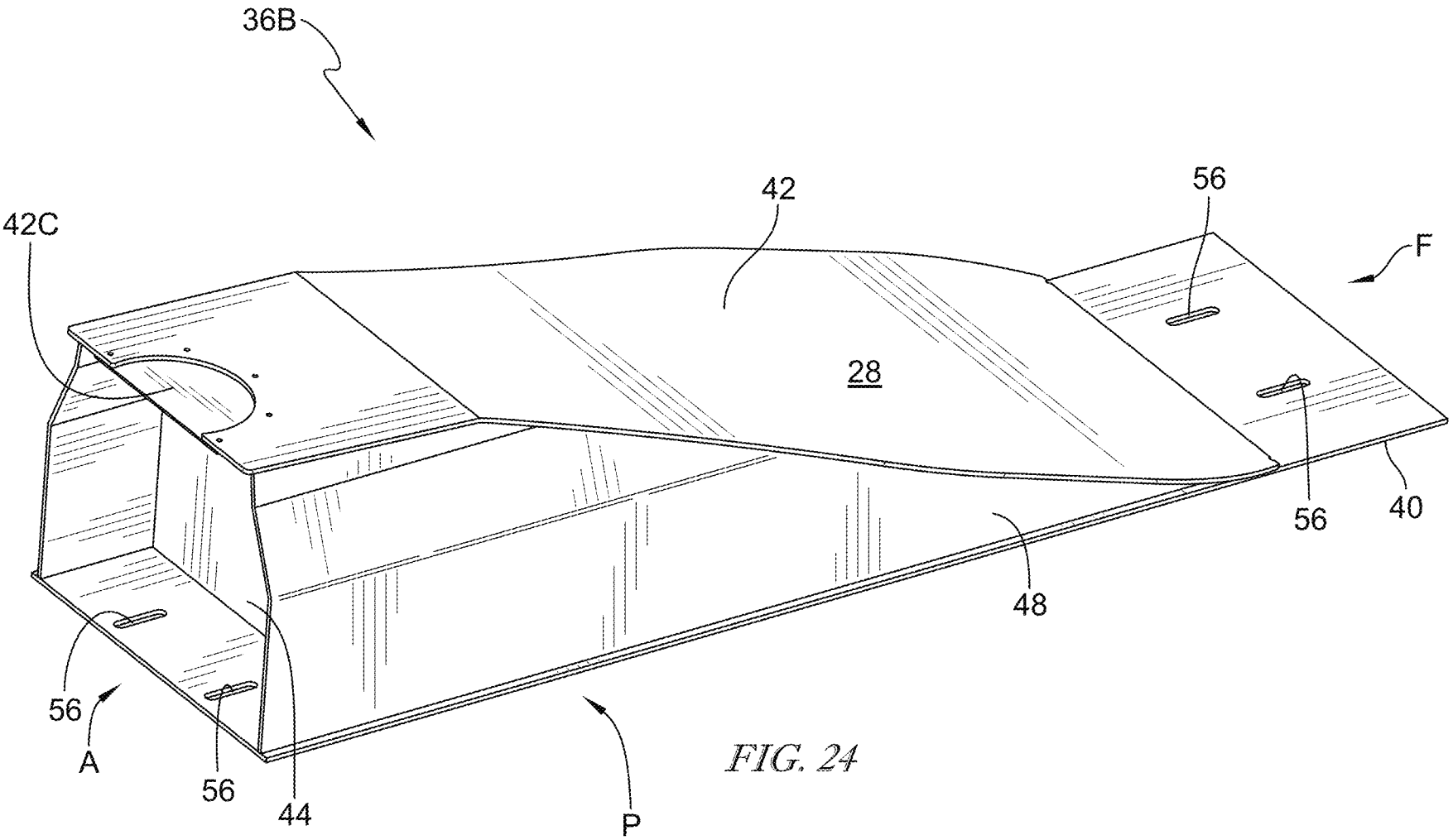
FIG. 24 is a lower, aft, port perspective view of the flotation pod of FIG. 23.
Figure 25:
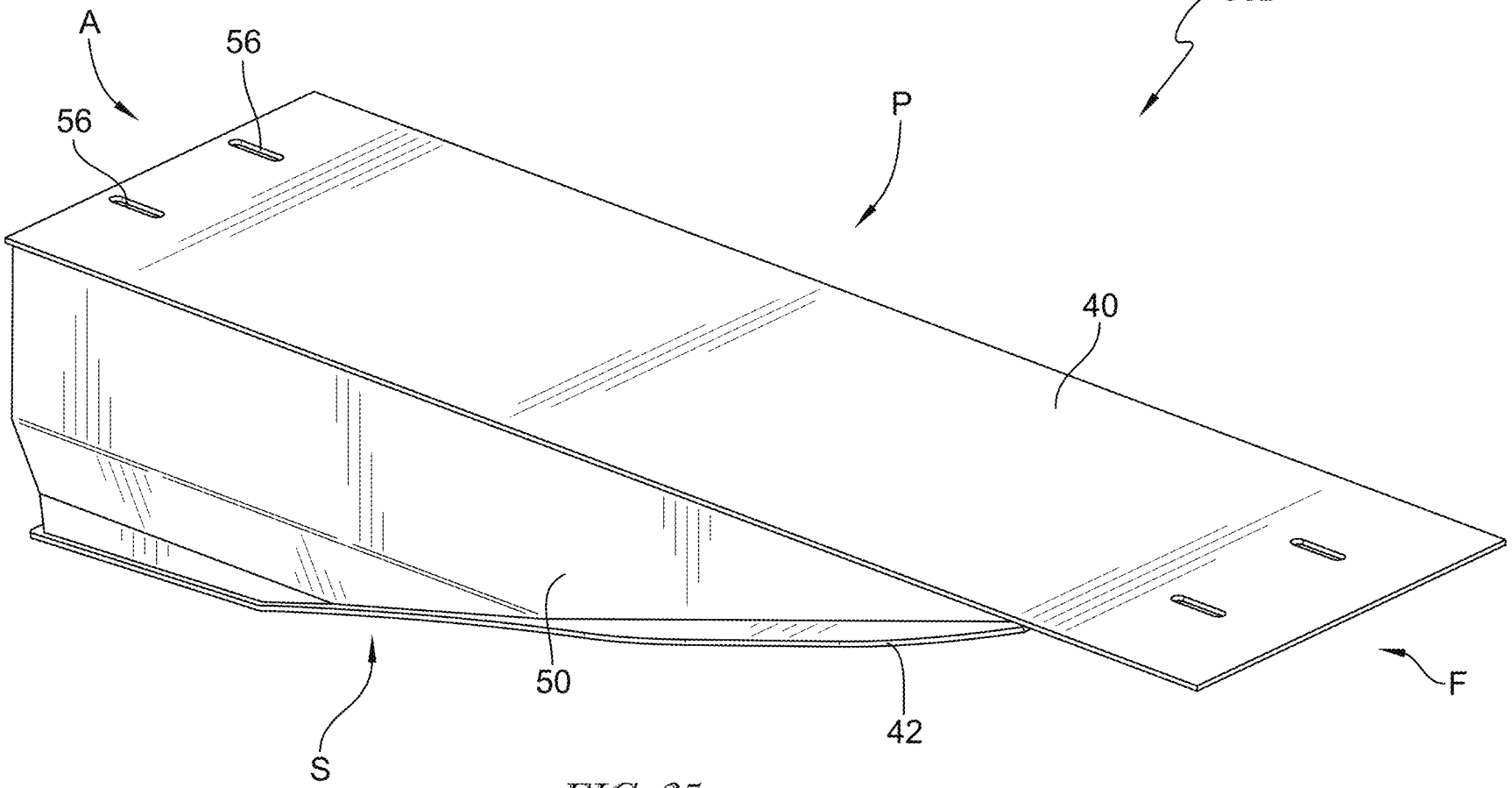
FIG. 25 is an upper, front, starboard perspective view of the flotation pod of FIG. 23.
Figure 26:
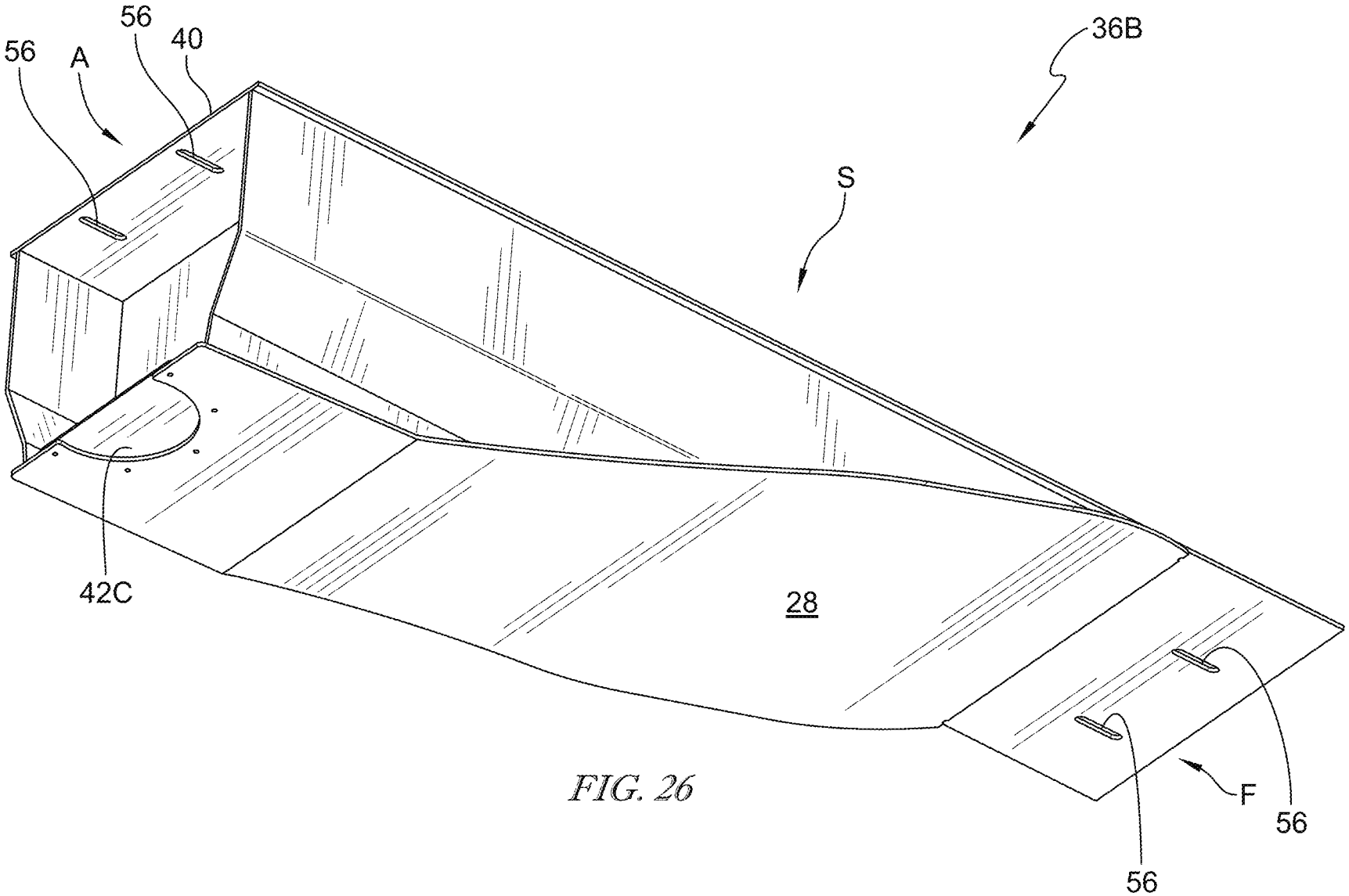
FIG. 26 is a lower, aft, starboard view of the flotation pod of FIG. 23.
Figure 27:
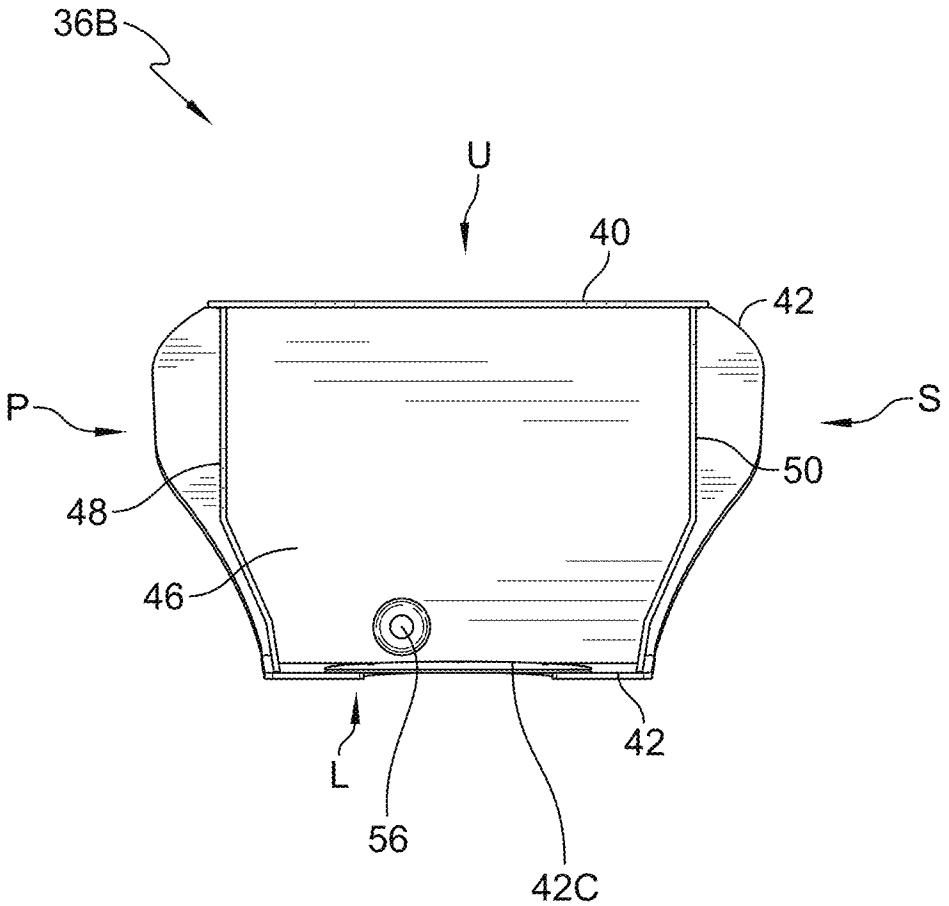
FIG. 27 is an aft elevation view of the flotation pod of FIG. 23.
Figure 28:
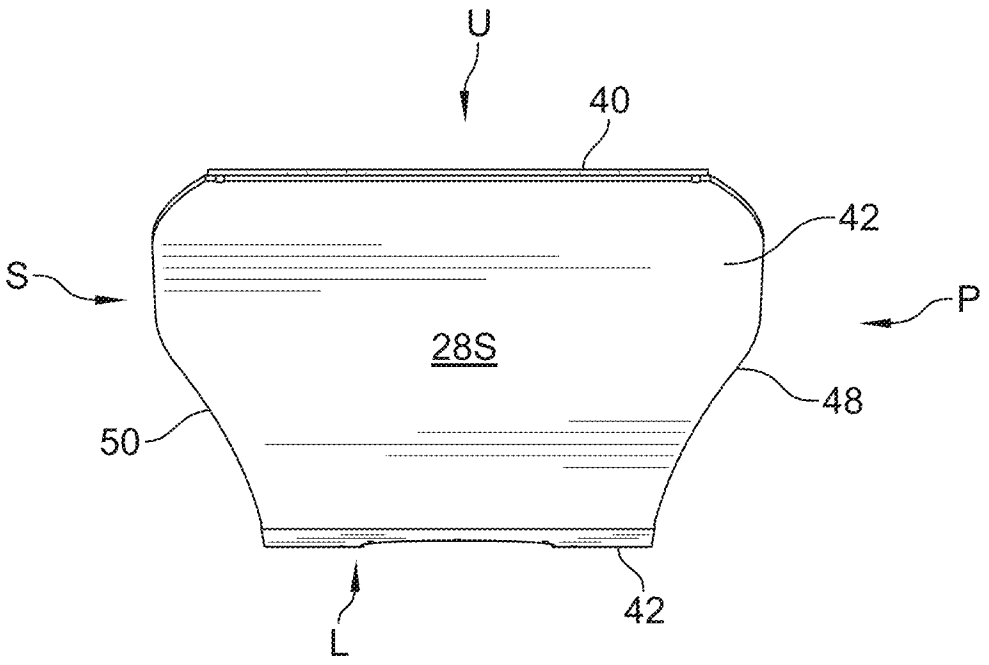
FIG. 28 is a front elevation view of the flotation pod of FIG. 23.
Figure 29:
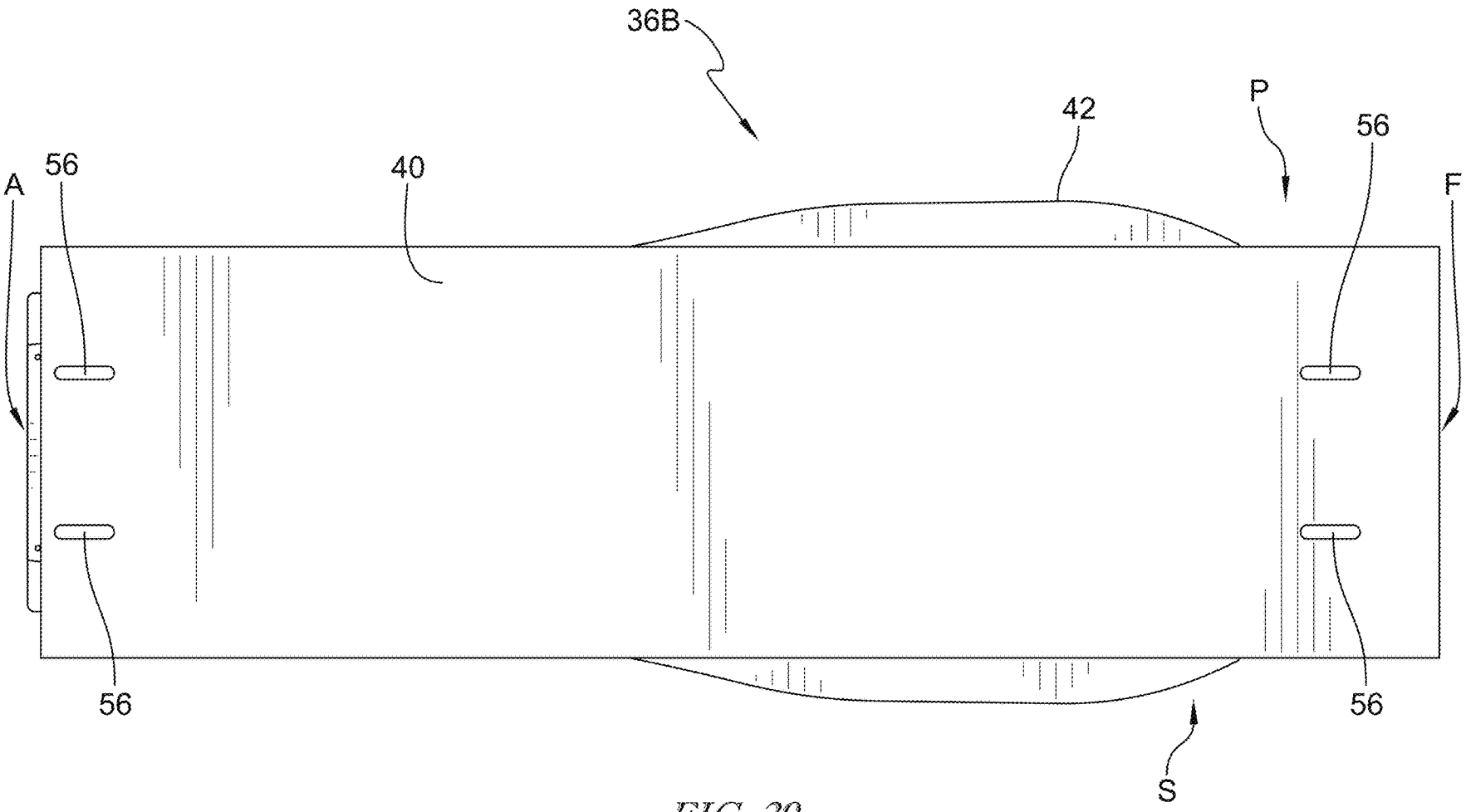
FIG. 29 is a top plan view of the flotation pod of FIG. 23.
Figure 30:
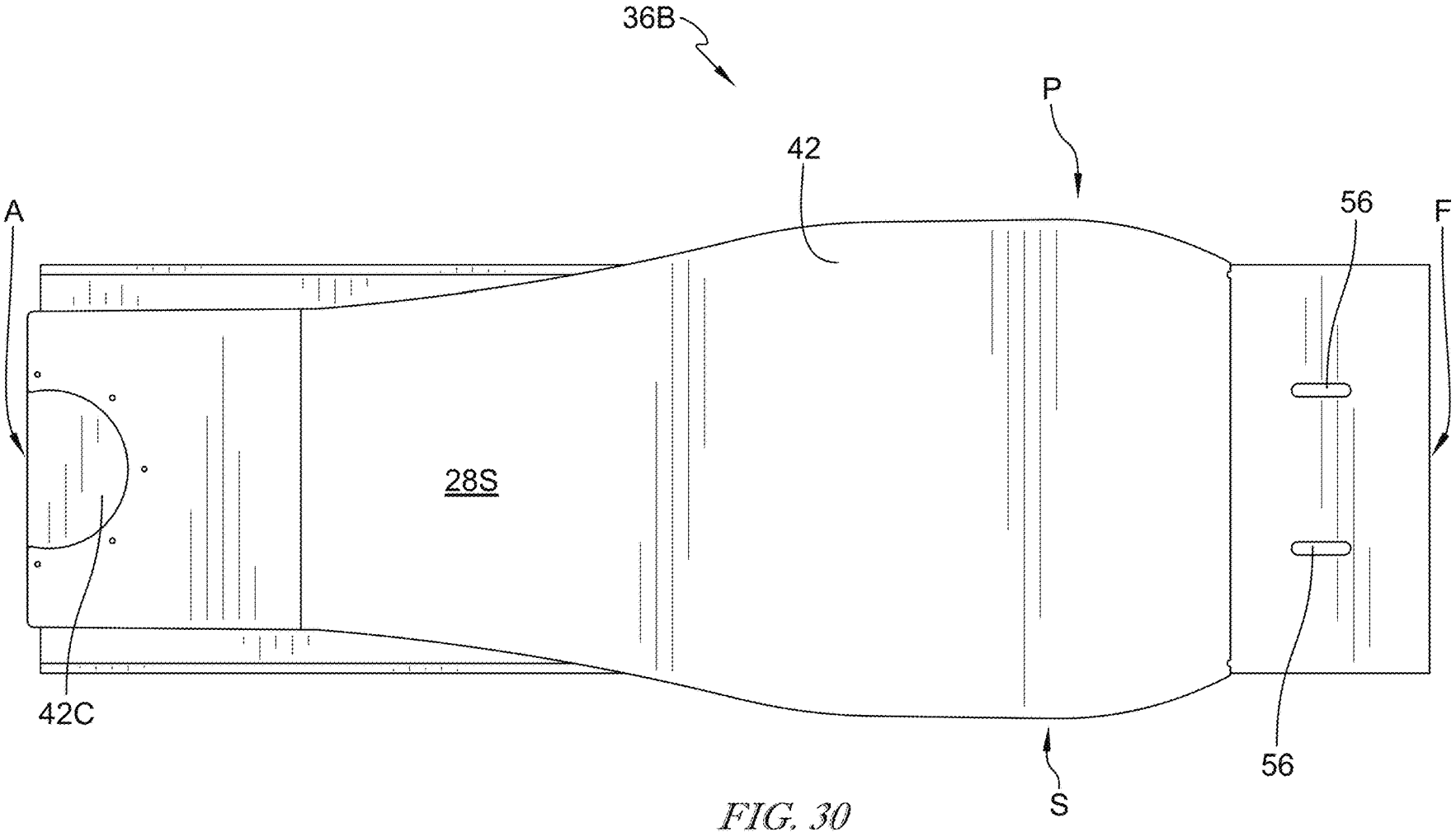
FIG. 30 is a bottom plan view of the flotation pod of FIG. 23.
Figure 31:
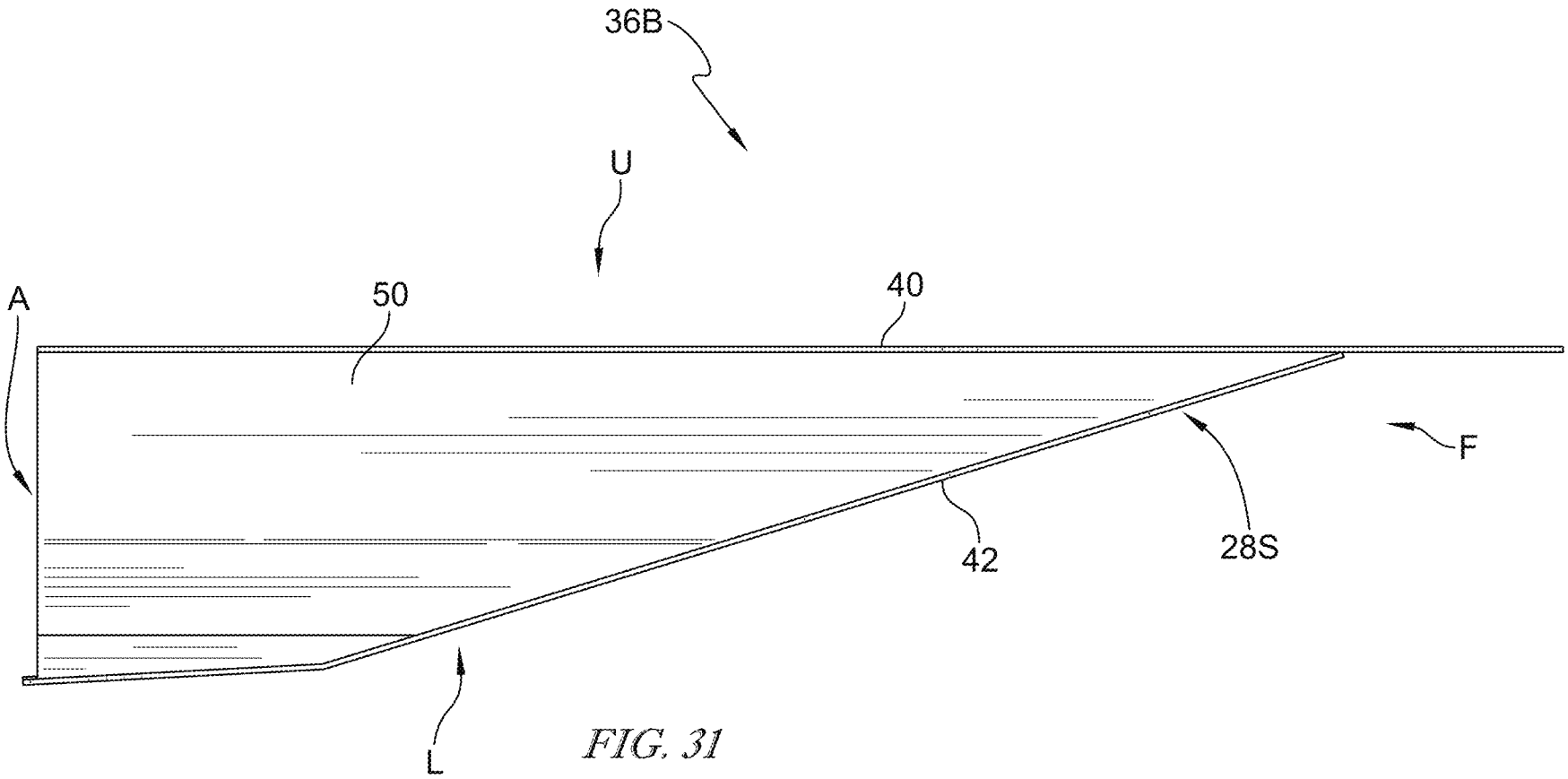
FIG. 31 is a starboard elevation view of the flotation pod of FIG. 23.
Figure 32:
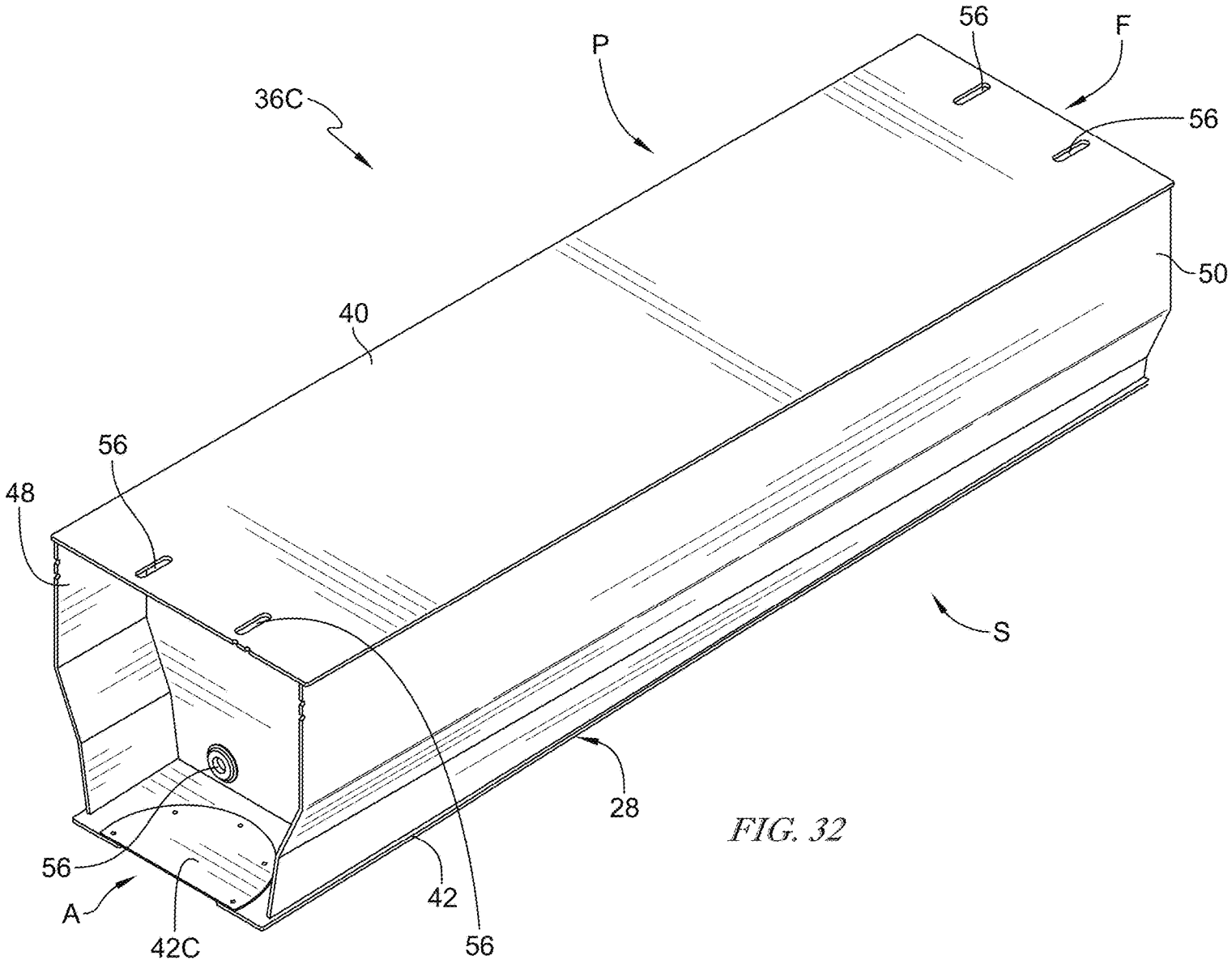
FIG. 32 is an upper, aft, starboard perspective view of another illustrative flotation pod according to the present disclosure.
Figure 33:
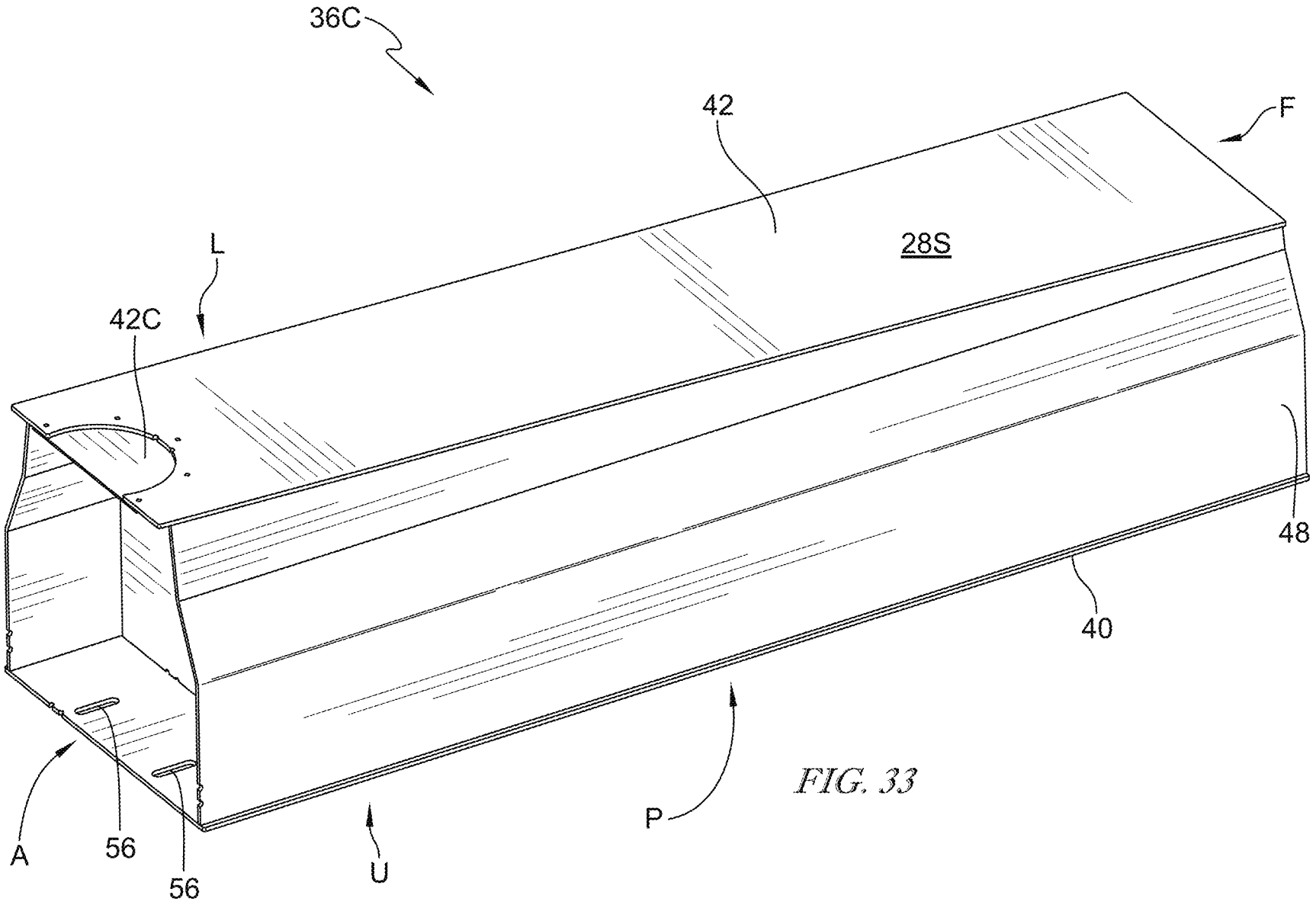
FIG. 33 is a lower, aft, port perspective view of the flotation pod of FIG. 32.
Figure 34:
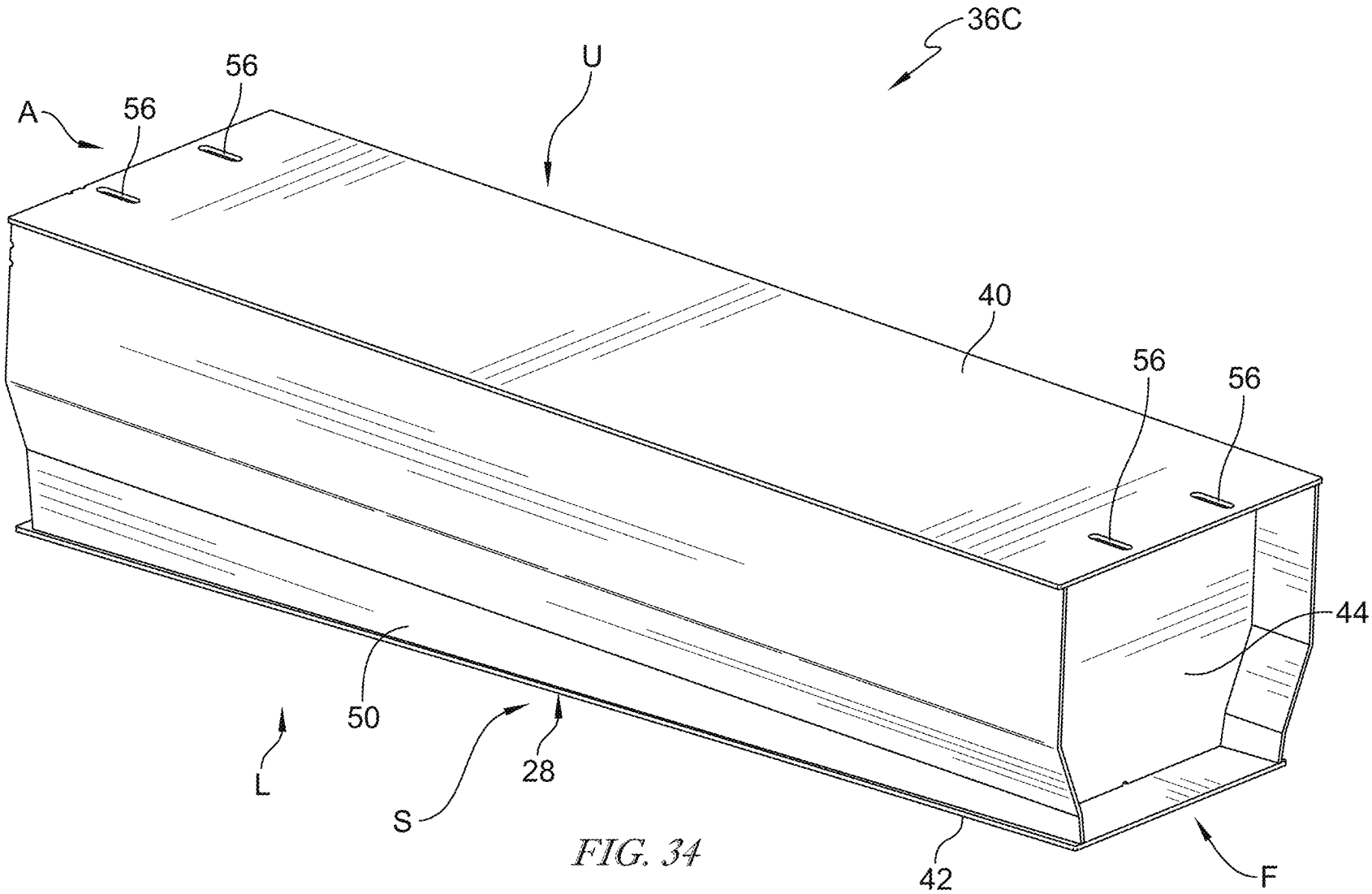
FIG. 34 is an upper, front, starboard perspective view of the flotation pod of FIG. 32.
Figure 35:
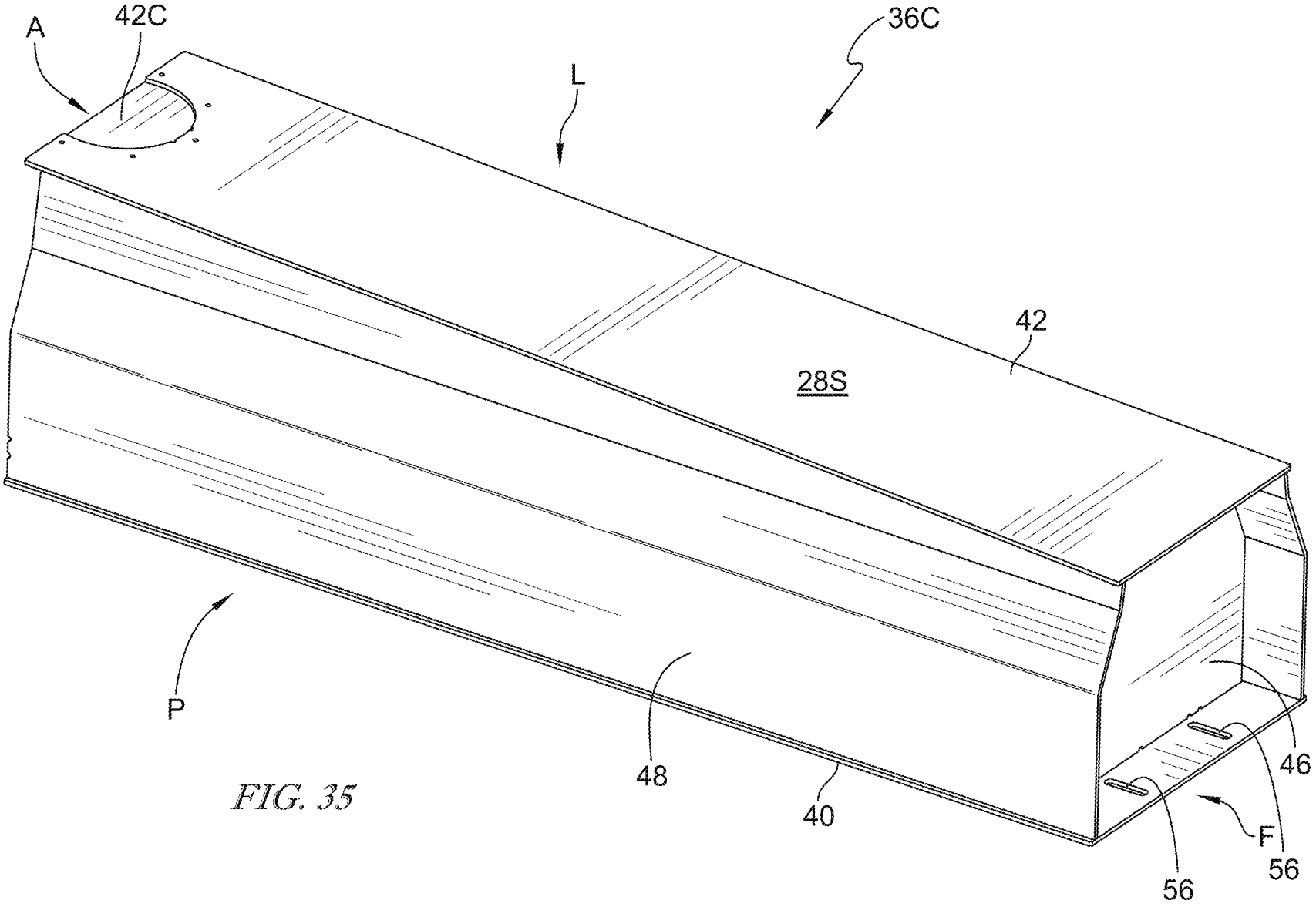
FIG. 35 is a lower, front, port view of the flotation pod of FIG. 32.
Figure 36:
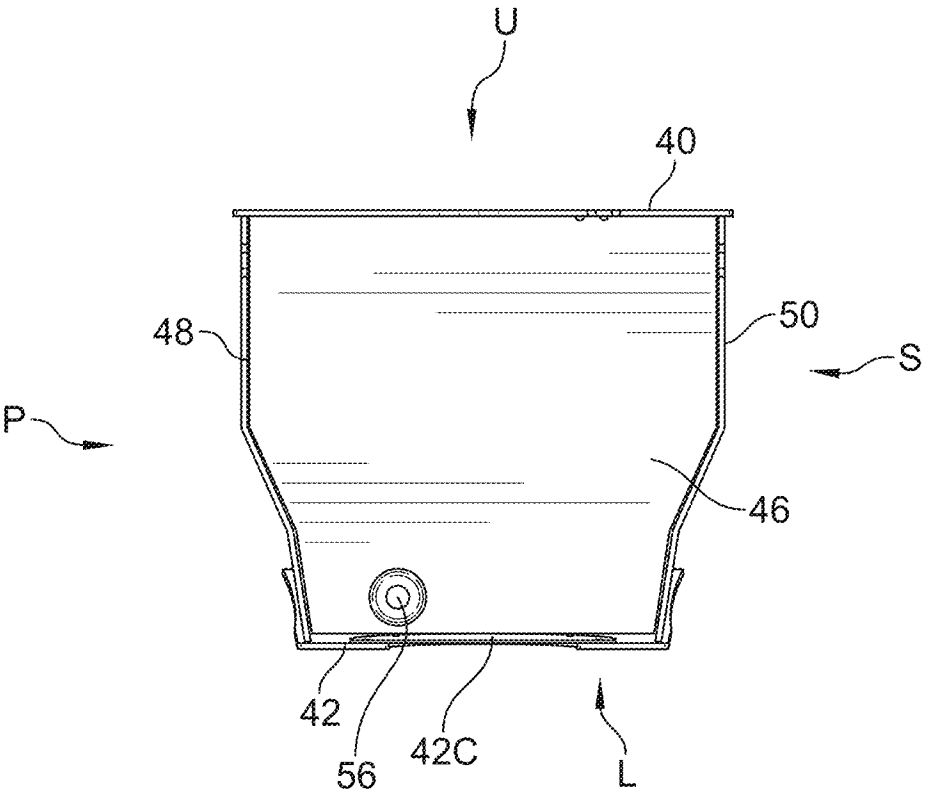
FIG. 36 is an aft elevation view of the flotation pod of FIG. 32.
Figure 37:
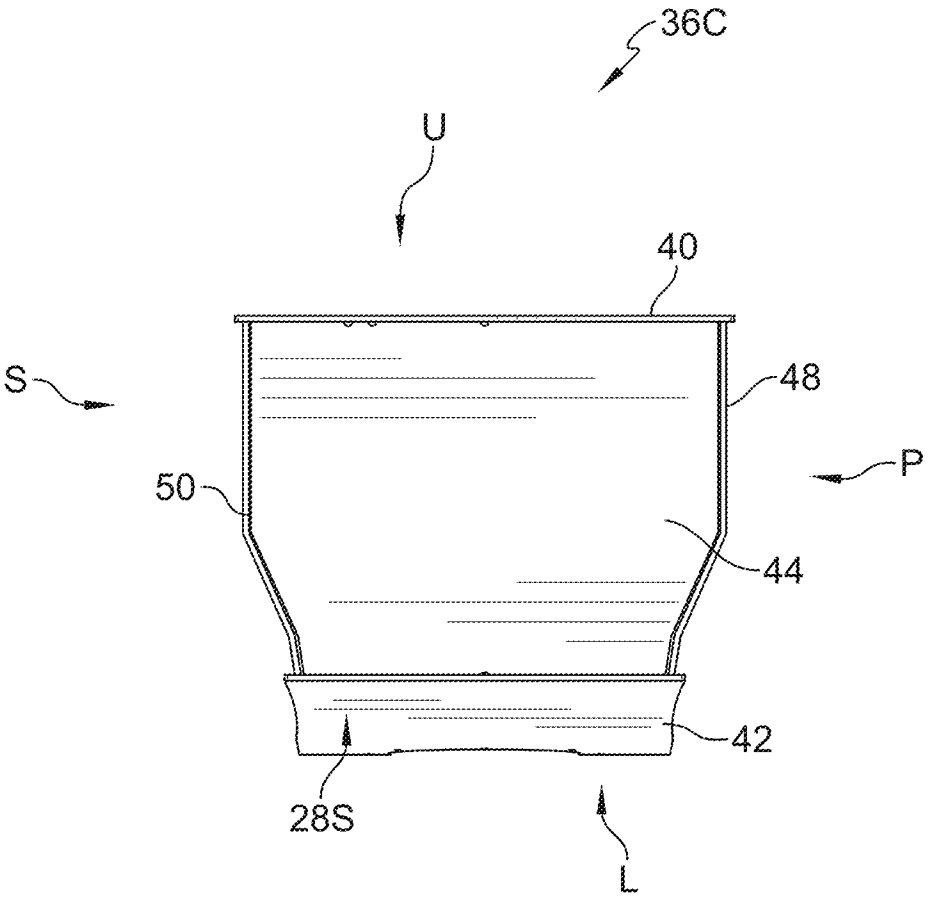
FIG. 37 is a front elevation view of the flotation pod of FIG. 32.
Figure 38:
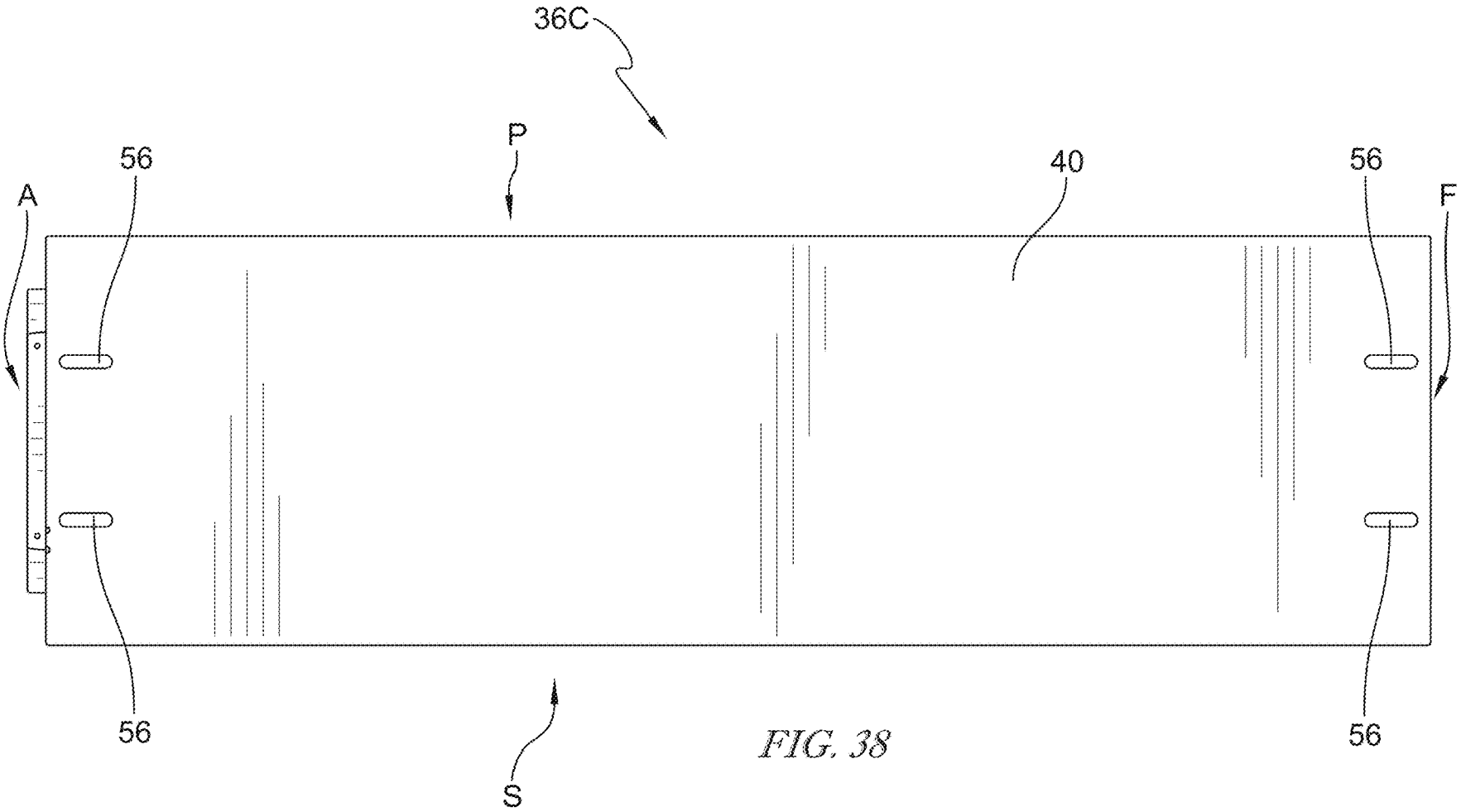
FIG. 38 is a top plan view of the flotation pod of FIG. 32.
Figure 39:
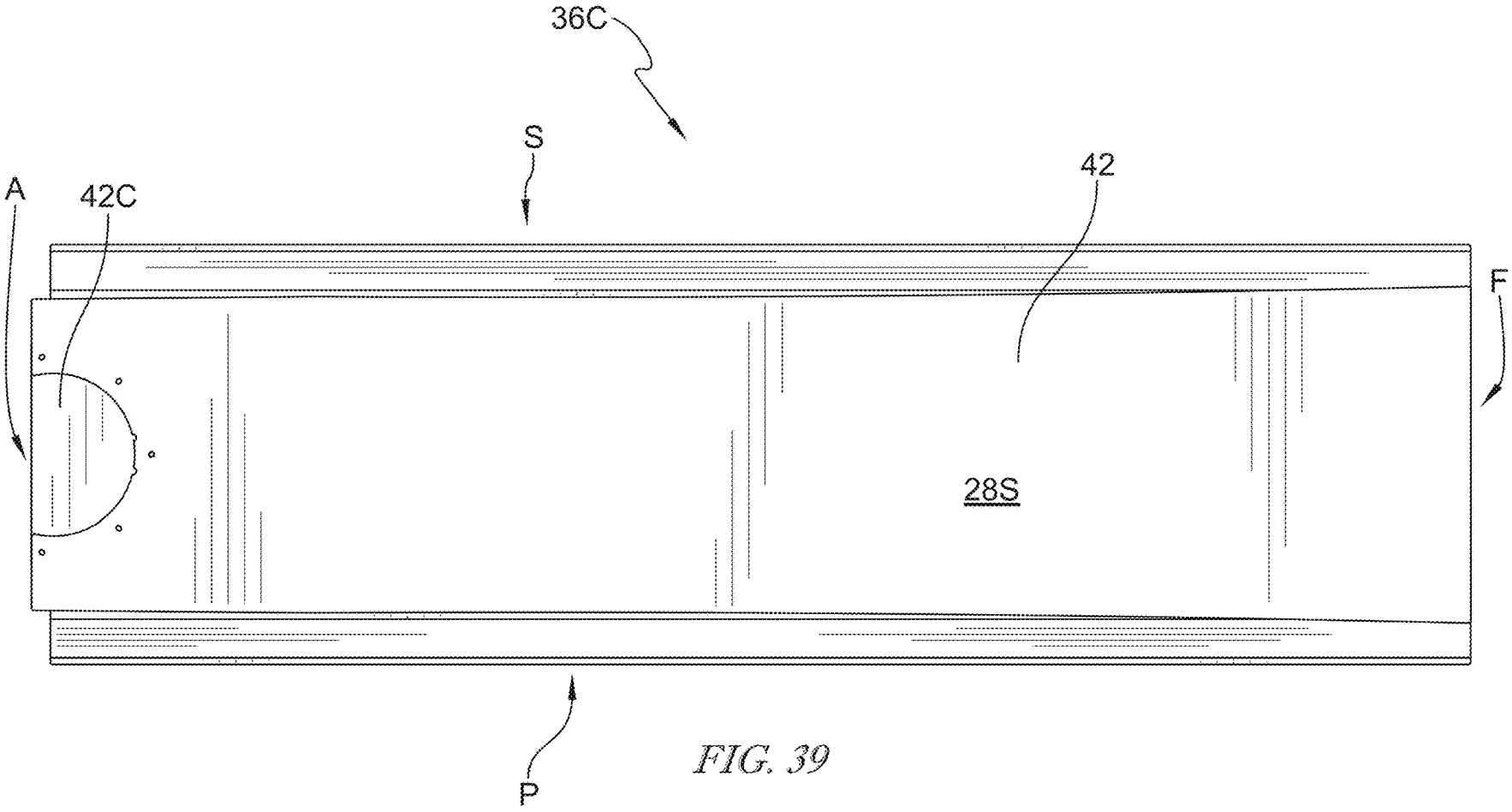
FIG. 39 is a bottom plan view of the flotation pod of FIG. 32.
Figure 40:
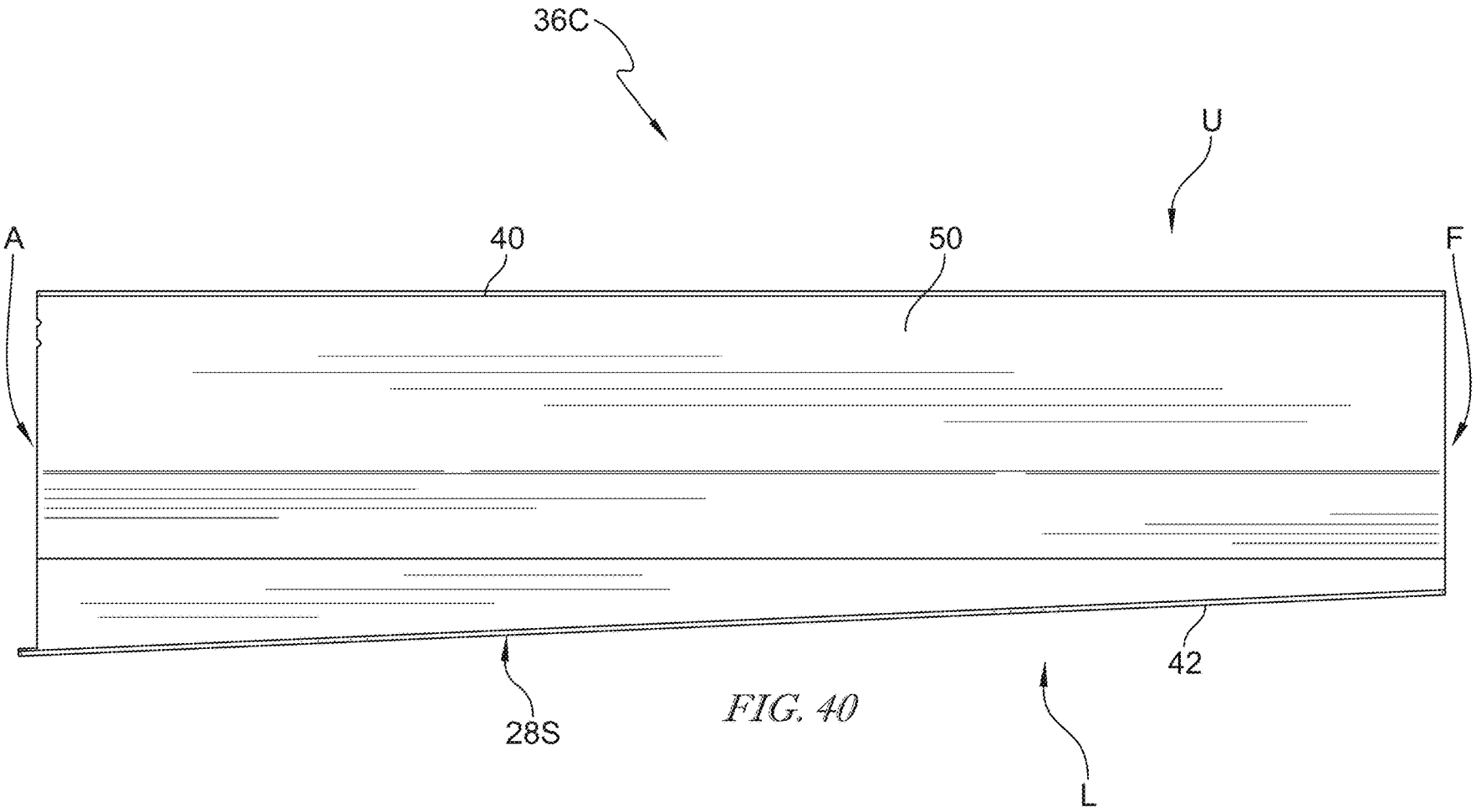
FIG. 40 is a starboard elevation view of the flotation pod of FIG. 32.
Figure 41:
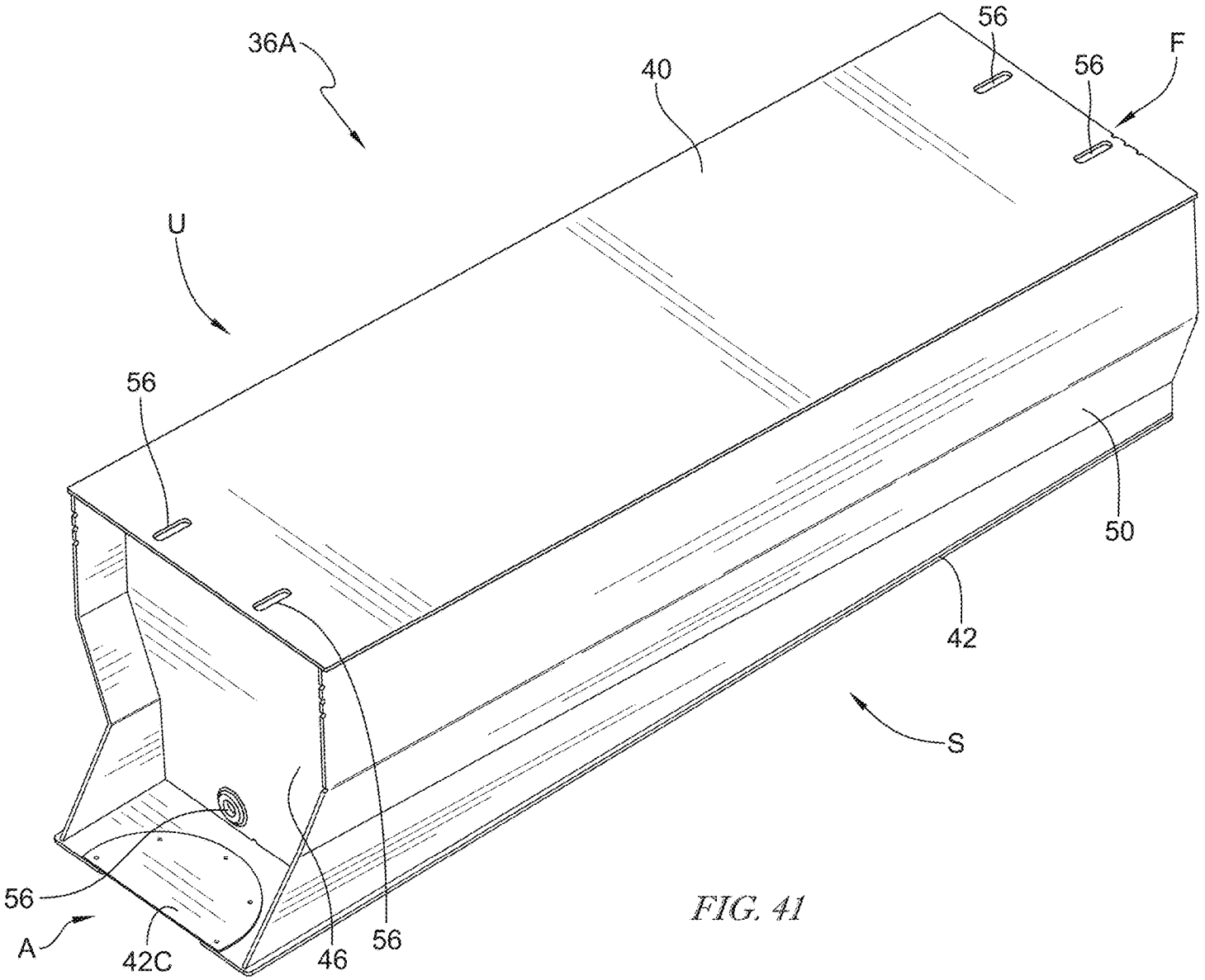
FIG. 41 is an upper, aft, starboard perspective view of yet another illustrative flotation pod according to the present disclosure.
Figure 42:
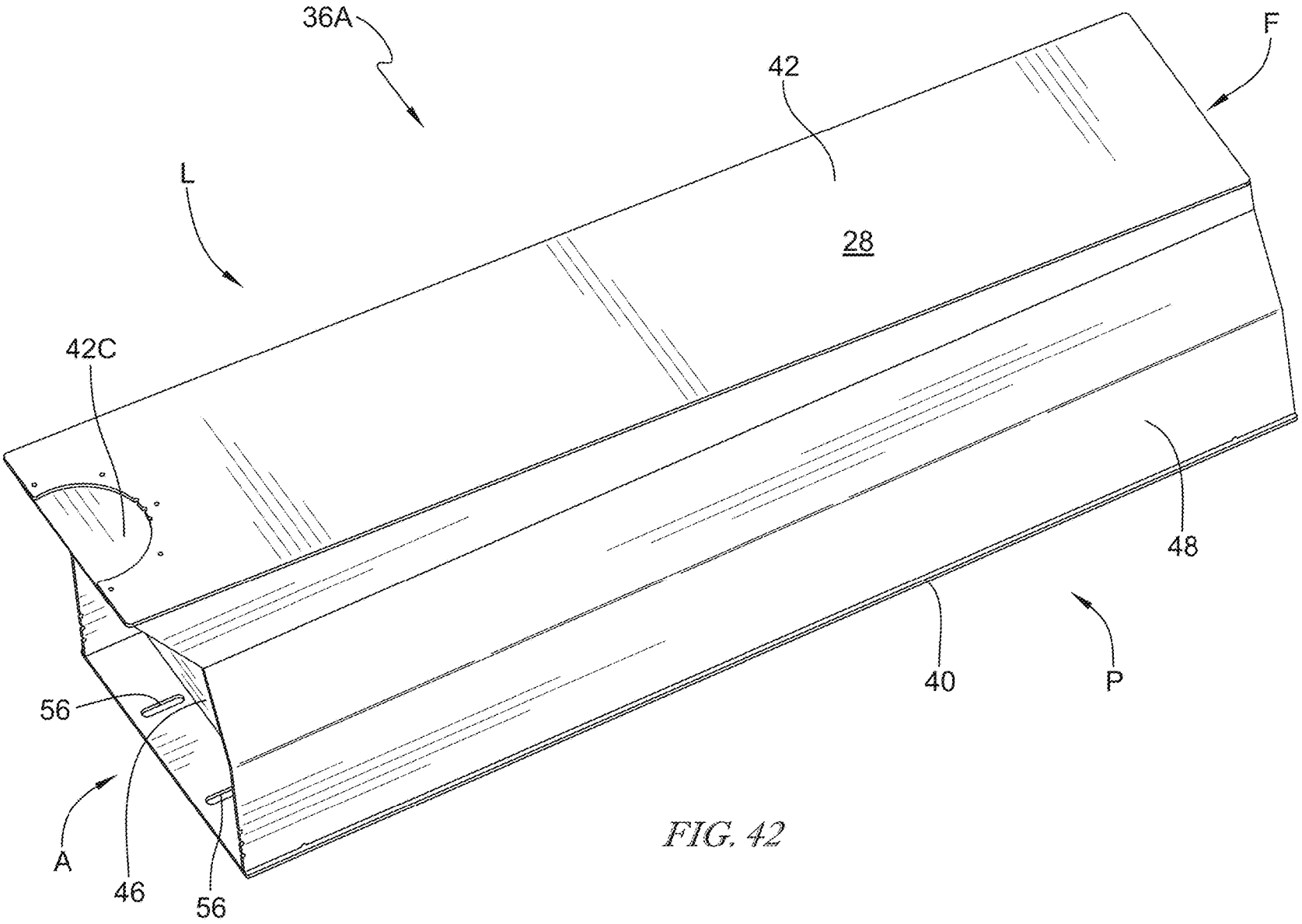
FIG. 42 is a lower, aft, port perspective view of the flotation pod of FIG. 41.
Figure 43:
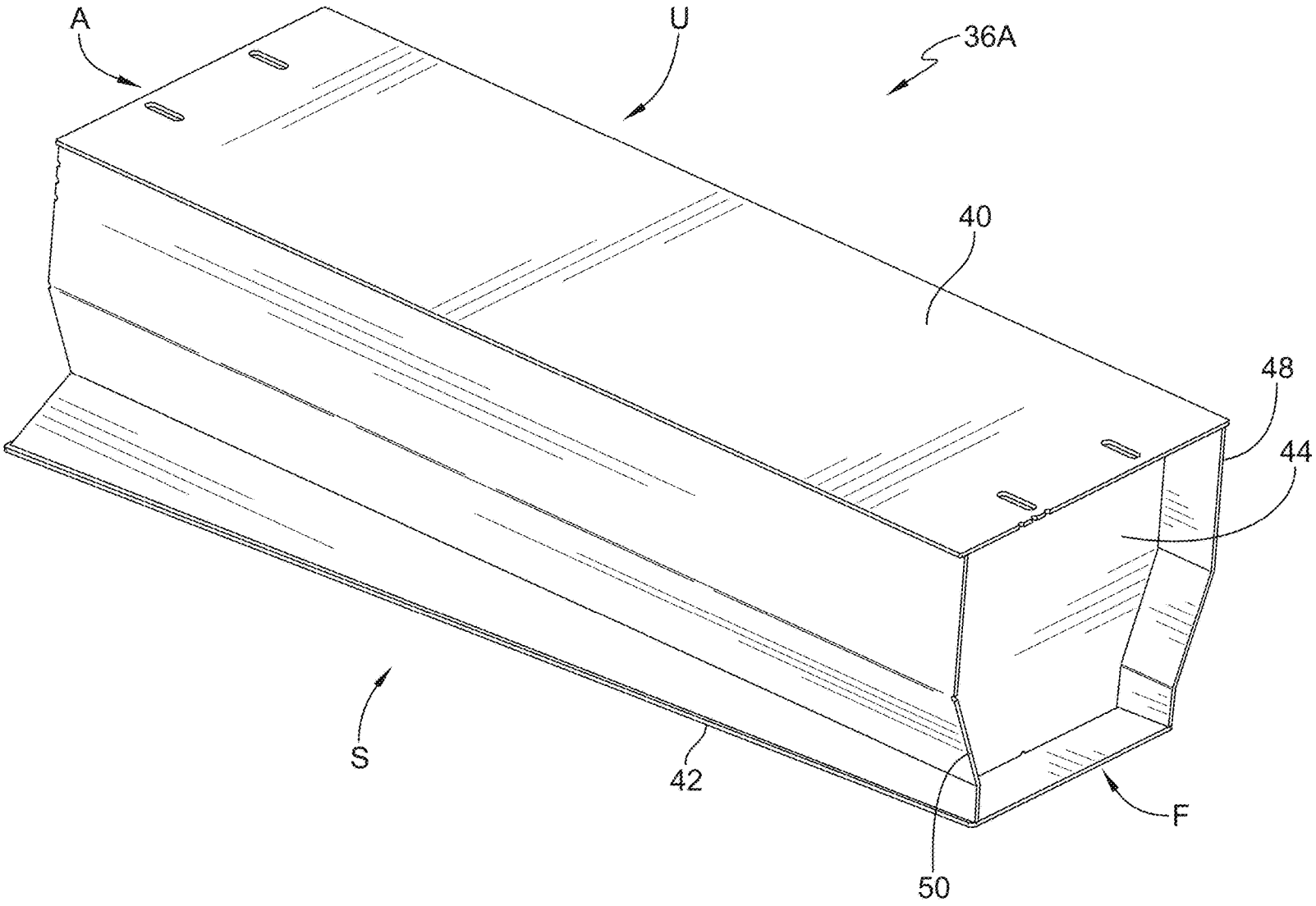
FIG. 43 is an upper, front, starboard perspective view of the flotation pod of FIG. 41.
Figure 44:
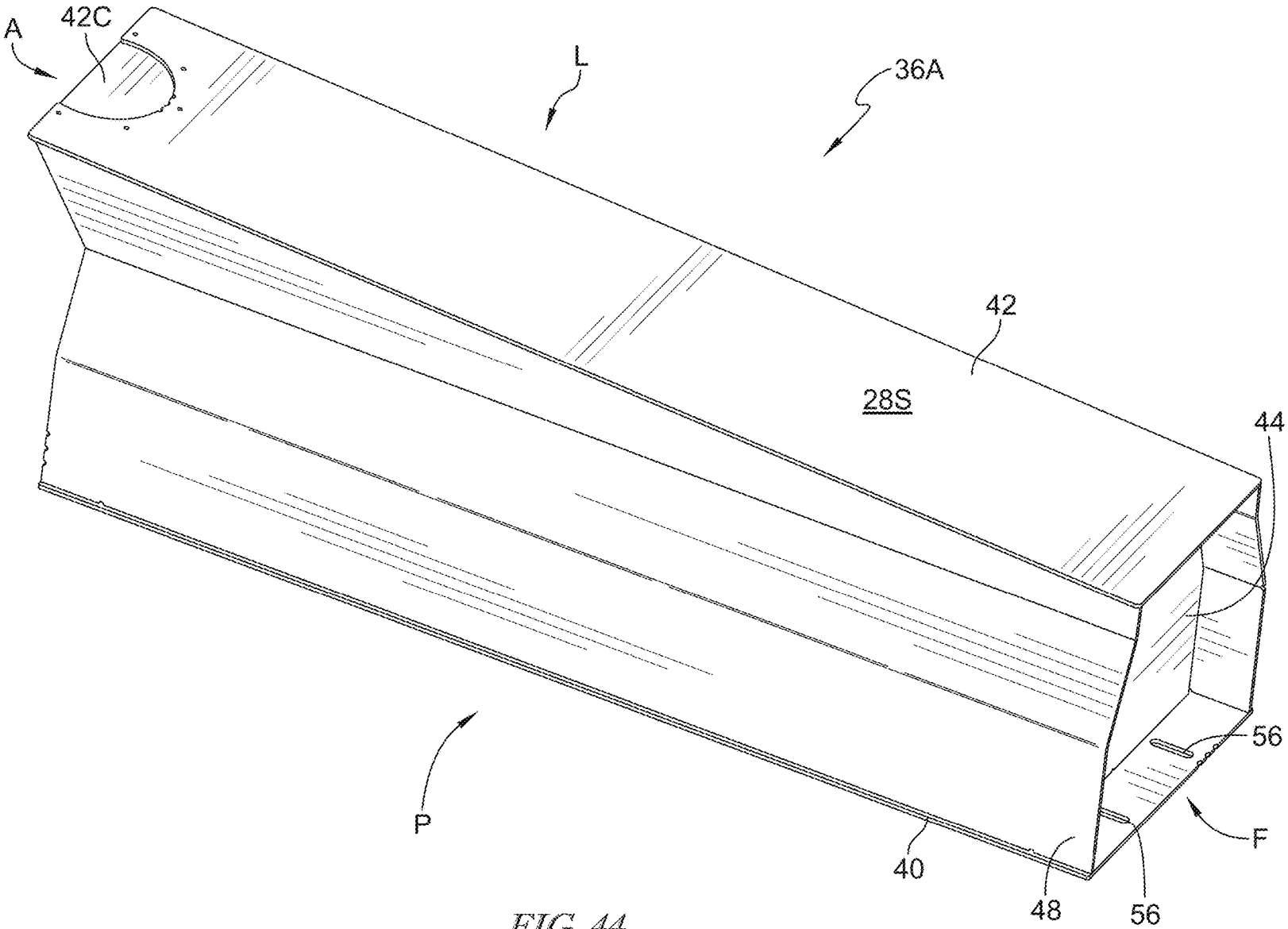
FIG. 44 is a lower, front, port view of the flotation pod of FIG. 41.
Figure 45:
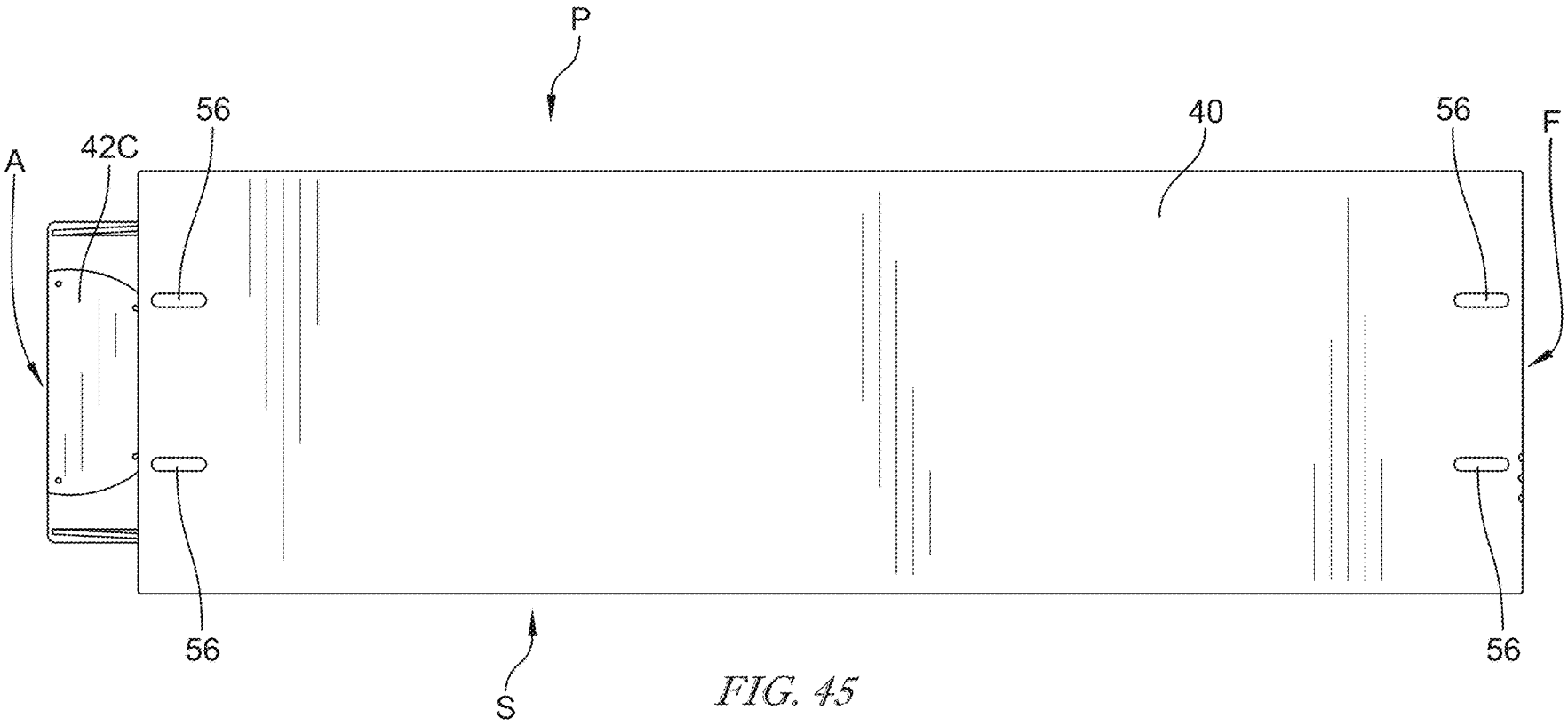
FIG. 45 is an aft elevation view of the flotation pod of FIG. 41.
Figure 46:
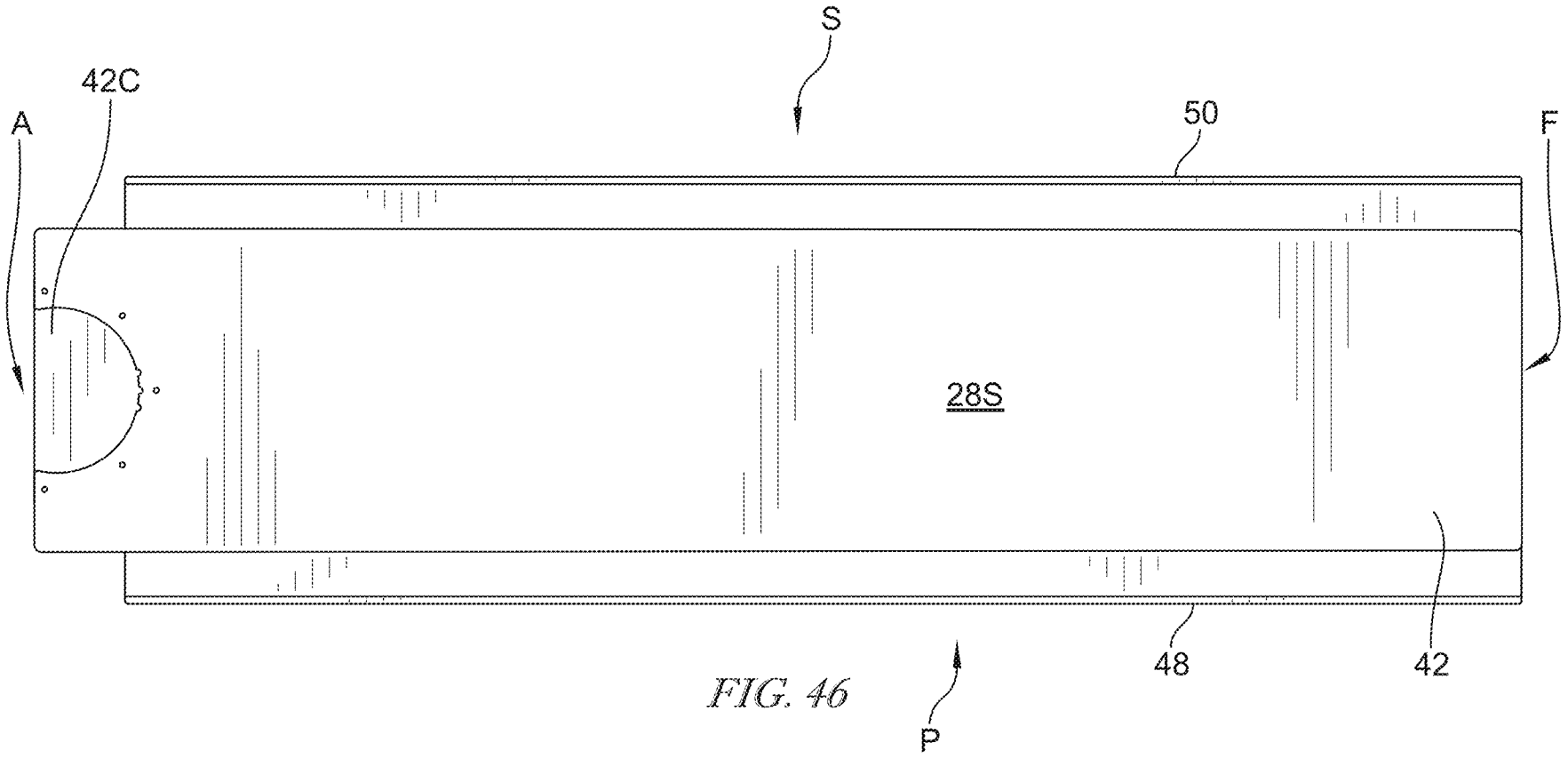
FIG. 46 is a front elevation view of the flotation pod of FIG. 41.
Figure 47:
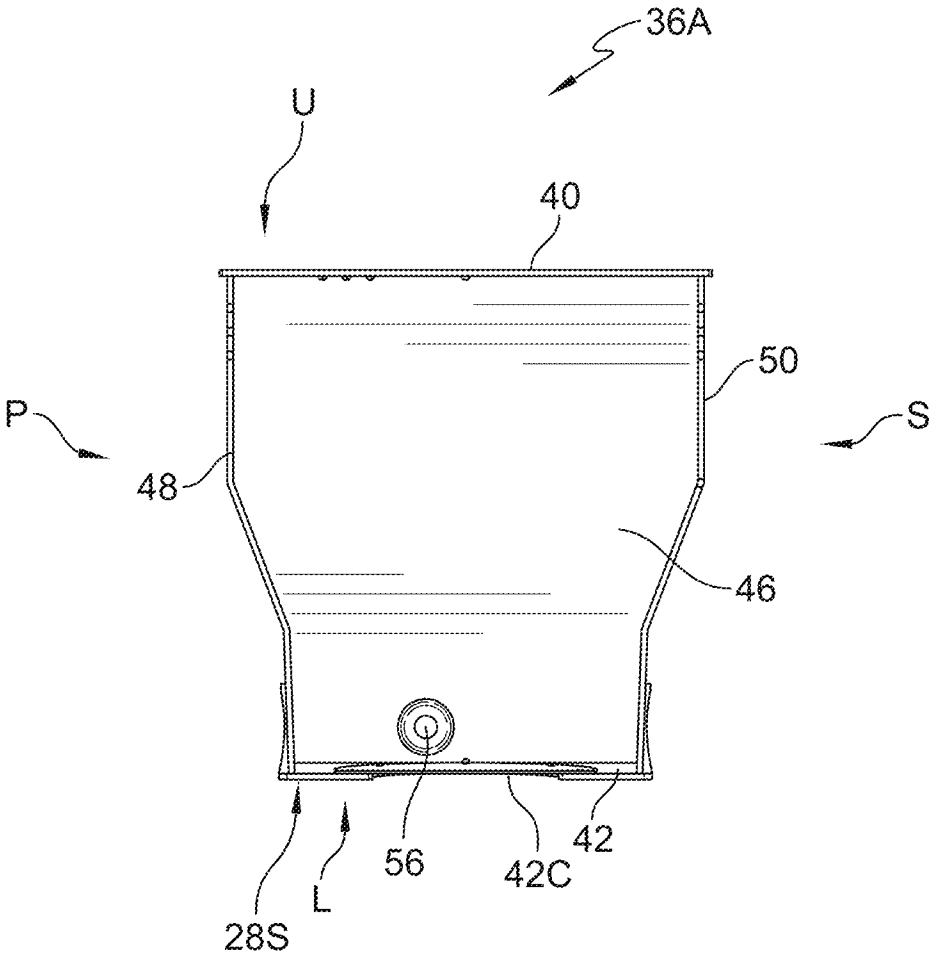
FIG. 47 is a top plan view of the flotation pod of FIG. 41.
Figure 48:
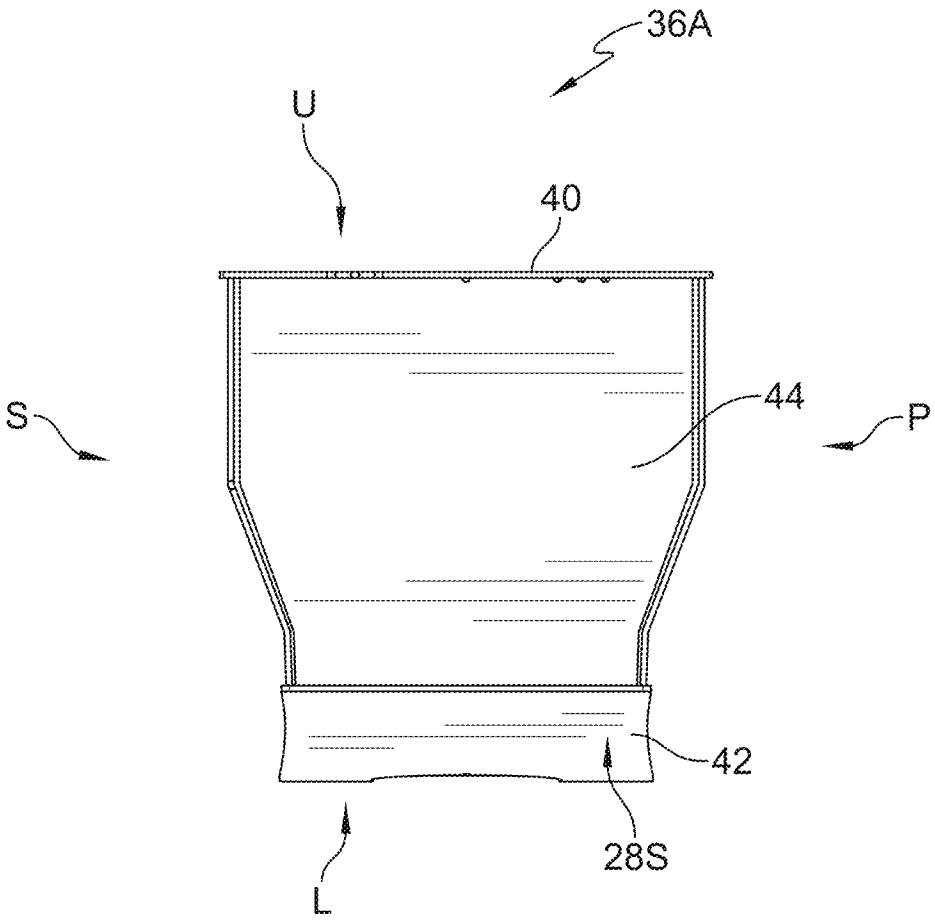
FIG. 48 is a bottom plan view of the flotation pod of FIG. 41.
Figure 49:
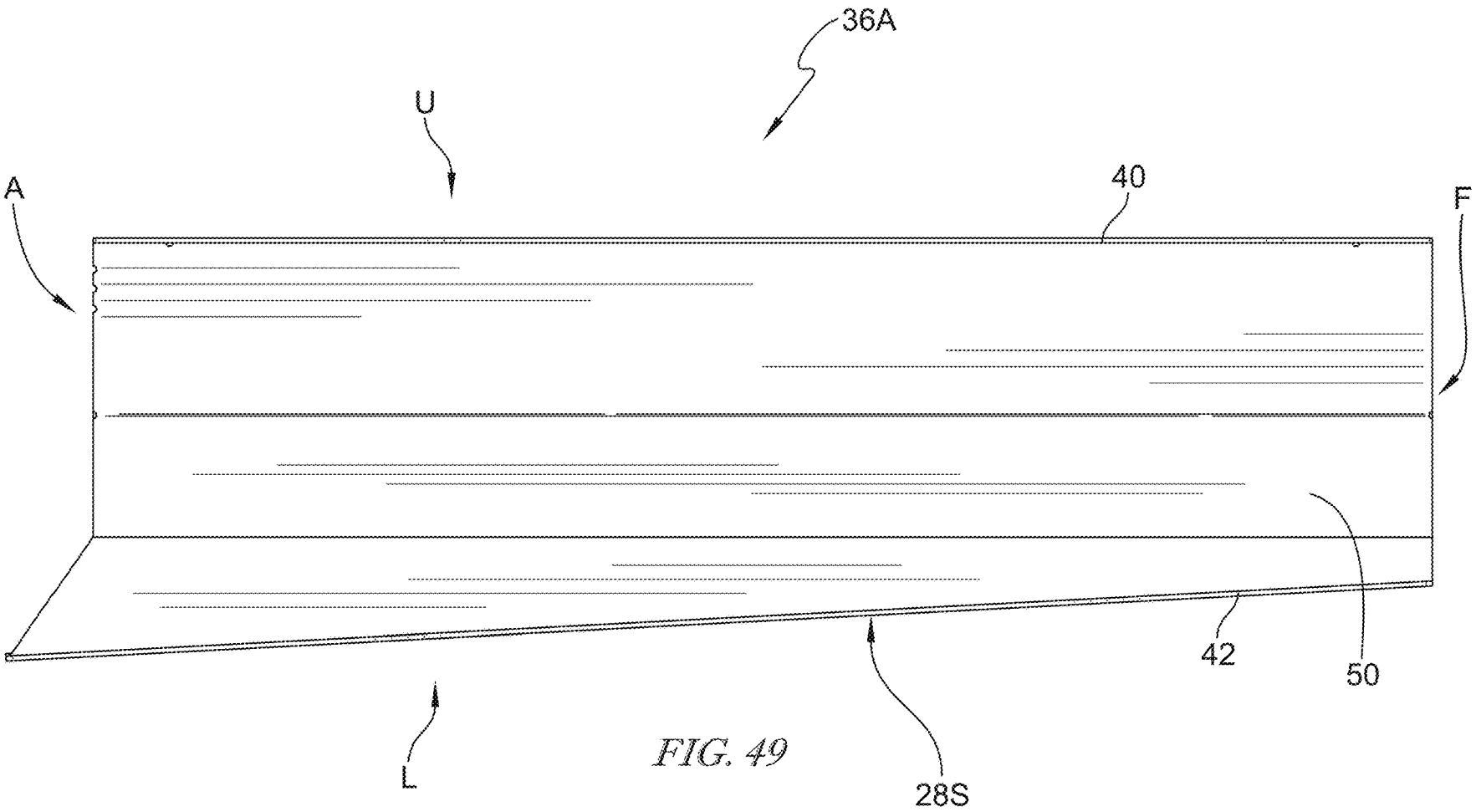
FIG. 49 is a starboard elevation view of the flotation pod of FIG. 41.

As suggested above, the lower wall 42 of the first set of flotation pods 36 is configured to define the first inclined running surface 28S. As such, the aft wall 46 of the first set of flotation pods 36 extends to a greater depth than the forward end of the first set of flotation pods 36. Also, the forward end of the lower wall 42 of the first set of flotation pods 36 may flare laterally outwardly (in a port-to-starboard direction) to better conform to the outer wall of the pontoons adjacent thereto. For example, FIG. 7 shows the forward end of the lower wall 42 of the first set of flotation pods 36 flared laterally outwardly to better conform to the outer wall of the port and center pontoons 16, 20 adjacent thereto.

The upper wall 40 of each flotation pod 36*n* defines one or more apertures 56 configured to receive a shaft of a mechanical fastener (not shown), for example, a bolt that may be connected to the frame 12, therethrough. In embodiments, the front wall 44 (where provided) and the aft wall 46 may be recessed from the respective ends of at least the upper wall 40 and the lower wall 42 to provide access to the apertures 56 to enable installation and removal of such mechanical fasteners (not shown). Also, the lower wall 42 may define an access opening through which an installer may extend a fastener, a tool, and/or a hand to facilitate connection of the flotation pod 36*n* to the frame 12. A removable cover 42C may be provided to otherwise cover the access opening. A gasket (not shown) may be installed between the lower wall 42 and the cover 42C.

The flotation pods 36*n* of the first set of flotation pods 36 may be made of any suitable material, for example without limitation, aluminum, plastic, fiberglass, or carbon fiber. Plastic flotation pods could be, but need not be, made using a roto-molding process.

As suggested above in connection with the description of, for example, the first ramp 28 and the first inclined running surface 28S, surfaces of the flotation pods 36*n* of the first set of flotation pods 36 may be adjacent to or in abutment with any or all of the port pontoon 16, the center pontoon 20, and the motor pod 22. It follows that surfaces of at least some of the walls 40, 42, 44 (if provided), 46, 48, 50 surfaces of the flotation pods 36*n* of the first set of flotation pods 36 may have shapes complementary to shapes of surfaces of corresponding ones of the adjacent or abutting port pontoon 16, the center pontoon 20, and the motor pod 22.

The surfaces of the of the flotation pods 36*n* of the first set of flotation pods 36 may be, but need not be, spaced from the port pontoon 16, thereby defining a gap between the first ramp 28 and the port pontoon 16. Similarly, the surfaces of the of the flotation pods 36*n* of the first set of flotation pods 36 may be, but need not be, spaced from the center pontoon 20, thereby defining a gap between the first ramp 28 and the center pontoon 20. Likewise, the surfaces of the of the flotation pods 36*n* of the first set of flotation pods 36 may be, but need not be, spaced from the motor pod 22, thereby defining a gap between the first ramp 28 and the motor pod 22. Such gaps may be filled, for example, as discussed above in connection with the filling of gaps between the motor pod 22 and the port, starboard, and center pontoons 16, 18, 20.

The flotation pods 36*n*, 38*n* of the first and second sets of flotation may be used in connection with a conventional pontoon boat having a conventional motor pod and transom, as well as with the pontoon boat 10 and motor pod 22 and transom described herein.

In embodiments, the principles of the foregoing disclosure may be applied to other watercraft, for example without limitation a catamaran, by substituting a first hull or other buoyant structure, for example without limitation a V-hull, for the first pontoon 16, substituting a second hull or other buoyant structure for the second pontoon 18, and/or substituting an optional third hull or other buoyant structure for the optional third pontoon 20.

Certain embodiments of watercraft are illustrated and described herein. These disclosures are exemplary, and not limiting. One skilled in the art would recognize that modifications may be made thereto without departure from the scope of the appended claims.

The invention claimed is:

1. A pontoon boat comprising:

a frame having a forward end, an aft end, a port side, and a starboard side;

a first pontoon having a forward end, an aft end, a port side, a starboard side, a lower end, and an upper end, wherein the first pontoon is connected to the frame, wherein the first pontoon is located proximate the port side of the frame, wherein the first pontoon extends in a first direction from proximate the aft end of the frame to proximate the forward end of the frame, and wherein a lowermost extent of the lower end of the first pontoon is located at a first depth relative to a point of the frame;

a second pontoon having a forward end, an aft end, a port side, a starboard side, a lower end, and an upper end, wherein the second pontoon is connected to the frame, wherein the second pontoon is located proximate the starboard side of the frame, wherein the second pontoon extends in the first direction from proximate the aft end of the frame to proximate the forward end of the frame, and wherein a lowermost extent of the lower end of the second pontoon is located at a second depth relative to the point of the frame;

a motor pod having a forward end, a forward portion proximate the forward end, an aft end, an aft portion proximate the aft end, a port side, a starboard side, and a lower side, wherein the motor pod is connected to the frame, wherein the motor pod is located proximate the aft end of the frame, wherein the forward portion of the motor pod is located between the first pontoon and the second pontoon, wherein the aft portion of the motor pod extends aft of the first pontoon and the second pontoon, and wherein the lower side of the motor pod has a lowermost surface at a third depth relative to the point of the frame;

a first inclined running surface having a forward end, an aft end, a port side, and a starboard side, wherein the first inclined running surface is connected to the frame, wherein the first inclined running surface is located forward of the motor pod and between the first pontoon and the second pontoon, and wherein the first inclined running surface extends downwardly and rearwardly from proximate the forward end of the first inclined running surface to proximate the aft end of the first inclined running surface and to a fourth depth relative to the point of the frame, a third pontoon between the first pontoon and the second pontoon, the third pontoon having a forward end, an aft end, a port side, a starboard side, a lower end, and an upper end, wherein a lowermost extent of the lower end of the third pontoon is located at a fifth depth relative to the point of the frame, wherein each of the first depth and the second depth is substantially greater than each of the third depth and the fourth depth, and wherein the aft portion of the motor pod has a width greater than any distance between the starboard side of the first pontoon and the port side of the second pontoon.

2. The pontoon boat of claim 1, wherein the first inclined running surface is configured to engage with water underneath the pontoon boat and to provide lift to the pontoon boat when the pontoon boat is in operation.

3. The pontoon boat of claim 1 further comprising a first strake attached to a lower portion of the first pontoon at a sixth depth relative to the point of the frame, wherein the sixth depth is substantially greater than at least one of the third depth and the fourth depth.

4. The pontoon boat of claim 1 further comprising a first strake attached to a lower portion of the first pontoon at a sixth depth relative to the point of the frame, wherein the sixth depth is substantially greater than at least two of the third depth, the fourth depth, and the fifth depth.

5. The pontoon boat of claim 1 further comprising a first strake attached to a lower portion of the first pontoon at a sixth depth relative to the point of the frame, wherein the sixth depth is substantially greater than each of the third depth, the fourth depth, and the fifth depth.

6. The pontoon boat of claim 1, wherein the aft end of the third pontoon is forward of the forward end of the motor pod.

7. The pontoon boat of claim 1, wherein the aft end of the third pontoon is proximate the aft end of the first inclined running surface.

8. The pontoon boat of claim 1, wherein the aft end of the third pontoon is forward of the forward end of the motor pod and proximate the aft end of the first inclined running surface.

9. The pontoon boat of claim 1 wherein the motor pod defines a substantially watertight interior compartment.

10. The pontoon boat of claim 1 further comprising at least one motor having a propulsor, wherein the propulsor is located at a depth lower than the third depth and in a space aft of and between the first pontoon and the second pontoon.

11. The pontoon boat of claim 1, wherein the bottom of the motor pod is configured to engage with water underneath the pontoon boat and to provide lift to the pontoon boat when the pontoon boat is in operation.

12. The pontoon boat of claim 11, wherein the first inclined running surface is configured to engage with the water underneath the pontoon boat and to provide lift to the pontoon boat when the pontoon boat is in operation.

13. The pontoon boat of claim 1 wherein at least one of the third depth and the fourth depth is at a depth substantially midway between the upper end and the lower end of the first pontoon.

14. The pontoon boat of claim 13 wherein the first pontoon is substantially cylindrical.

15. The pontoon boat of claim 1, wherein at least a portion of the aft end of the first inclined running surface is located at the fourth depth and at least a portion of the forward end of the motor pod is located substantially at the fourth depth.

16. The pontoon boat of claim 15, wherein the third depth and the fourth depth are substantially equal.

17. The pontoon boat of claim 1, wherein the fifth depth is substantially greater than each of the third depth and the fourth depth.

18. The pontoon boat of claim 17, wherein the first inclined running surface is located between the first pontoon and the third pontoon, and wherein the pontoon boat further comprises a second inclined running surface between the second pontoon and the third pontoon.

19. The pontoon boat of claim 1 further comprising a first set of flotation pods having a forward end, an aft end, a port side, a starboard side, and a bottom surface, wherein the first set of flotation pods is connected to the frame, wherein the first set of flotation pods is located forward of the motor pod and between the first pontoon and the second pontoon, wherein the bottom surface of the first set of flotation pods extends downwardly and rearwardly from proximate the forward end of the first inclined running surface to proximate the aft end of the first inclined running surface and to the fourth depth relative to the point of the frame, and wherein the bottom surface of the first set of flotation pods defines the first inclined running surface.

20. The pontoon boat of claim 19 wherein the first set of flotation pods comprises a single flotation pod.

21. The pontoon boat of claim 19 wherein the first set of flotation pods comprises a forward flotation pod and an aft flotation pod.

22. The pontoon boat of claim 19 wherein the first set of flotation pods comprises a forward flotation pod, an aft flotation pod, and at least one intermediate flotation pod between the forward flotation pod and the aft flotation pod.

* * * * *